US011294326B2

(12) United States Patent
Fukuma

(10) Patent No.: US 11,294,326 B2
(45) Date of Patent: Apr. 5, 2022

(54) IMAGE FORMING APPARATUS HAVING LOCKABLE TONER CONTAINER

(71) Applicant: KYOCERA Document Solutions Inc., Osaka (JP)

(72) Inventor: Nobuhiro Fukuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/293,008

(22) PCT Filed: Dec. 4, 2019

(86) PCT No.: PCT/JP2019/047446

§ 371 (c)(1),
(2) Date: May 11, 2021

(87) PCT Pub. No.: WO2020/116519

PCT Pub. Date: Jun. 11, 2020

(65) Prior Publication Data

US 2021/0405575 A1 Dec. 30, 2021

(30) Foreign Application Priority Data

Dec. 5, 2018 (JP) ..... JP2018-228421

(51) Int. Cl.
*G03G 21/16* (2006.01)
*G03G 15/08* (2006.01)

(52) U.S. Cl.
CPC ..... *G03G 21/1647* (2013.01); *G03G 15/0865* (2013.01); *G03G 21/1676* (2013.01)

(58) Field of Classification Search
CPC ..... G03G 15/0865; G03G 21/1647; G03G 21/1676; G03G 2215/066; G03G 2221/163
See application file for complete search history.

(56) References Cited

U.S. PATENT DOCUMENTS

2017/0123343 A1* 5/2017 Fukuma ..... G03G 21/1676
2017/0235273 A1* 8/2017 Mimura ..... G03G 21/1676 399/12

FOREIGN PATENT DOCUMENTS

JP H09183522 A 7/1997
JP 2008030902 A 2/2008

* cited by examiner

*Primary Examiner* — Sophia S Chen
(74) *Attorney, Agent, or Firm* — Alleman Hall Creasman & Tuttle LLP

(57) ABSTRACT

An image forming apparatus includes a toner container, a support member, a lock member, a lock removing portion, and a moving mechanism. The toner container is attachable to an attachment position in an apparatus main body. The support member supports the toner container which is moved between the attachment position and a detachment position located toward a surface of the apparatus main body. The lock member is provided on the support member, is movable in a first direction along the surface, and is displaced between a lock position where the toner container is locked to the attachment position and a removal position. When a predetermined condition is satisfied, the lock removing portion moves the lock member to the removal position to remove a lock of the toner container. The moving mechanism moves the toner container toward the detachment position when the lock removing portion removes the lock.

10 Claims, 18 Drawing Sheets

IMAGE FORMING APPARATUS HAVING LOCKABLE TONER CONTAINER

TECHNICAL FIELD

The present invention relates to an image forming apparatus to which a toner container having a storage portion storing toner is attached in a detachable manner.

BACKGROUND ART

Conventionally, there is known an image forming apparatus configured to form an image on a sheet using developer including toner. This type of image forming apparatus is provided with a toner container that supplies the toner to a developing device provided within the image forming apparatus. The toner container is attached to an apparatus main body of the image forming apparatus in a detachable manner. When the toner in the toner container is consumed and the toner container becomes empty, the toner container is removed from the image forming apparatus and replaced with a new toner container filled with unused toner (see PTL 1).

When the toner container is replaced, a cover covering an opening of the apparatus main body formed in a top surface or a side surface thereof is opened, and the toner container is taken out from the inside of the apparatus main body through the opening, and a new toner container is attached to the inside of the apparatus main body through the opening.

CITATION LIST

Patent Literature

[PTL 1] Japanese Patent Application Publication No. 2012-32694

SUMMARY OF THE INVENTION

Problems to be Solved by the Invention

However, the cover attached to the top surface or the side surface of the apparatus main body is supported by the apparatus main body in such a way as to pivot around a hinge or the like. As a result, the cover needs to be configured to pivot around the hinge like a door. In this case, it is necessary to ensure a large space at the top surface or the side surface of the apparatus main body so that at least the cover can pivot when the toner container is replaced. This poses a problem of restricting the installment space of the image forming apparatus.

The present invention has been made in view of such conventional circumstances, and it is an object of the present invention to provide an image forming apparatus that can improve the freedom of setting the image forming apparatus by reducing a space required for replacement of the toner container as compared with a conventional one.

Solution to the Problems

An image forming apparatus according to an aspect of the present invention includes a toner container, a support member, a lock member, a lock removing portion, and a moving mechanism. The toner container is configured to be attached to an attachment position set in an apparatus main body. The support member is configured to support the toner container so that the toner container can be moved between the attachment position and a detachment position that is separated from the attachment position toward a predetermined first surface of the apparatus main body. The lock member is provided on the support member in such a way as to be movable in a first direction that extends along the first surface, the lock member configured to be displaced between a lock position and a removal position, wherein when the lock member is located at the lock position, the lock member is engaged with the toner container so that the toner container is locked to the attachment position, and when the lock member is located at the removal position, a lock of the toner container is removed. The lock removing portion is configured to, when a predetermined removal condition is satisfied, move the lock member from the lock position to the removal position to remove the lock of the toner container. The moving mechanism is configured to move the toner container toward the detachment position when the lock removing portion removes the lock.

Advantageous Effects of the Invention

According to the present invention, it is possible to improve the freedom of setting an image forming apparatus by reducing a space required for replacement of a toner container as compared with a conventional one.

DESCRIPTION OF EMBODIMENTS

The following describes an embodiment of the present disclosure with reference to the drawings. It should be noted that the following embodiment is an example of a specific embodiment of the present invention and should not limit the technical scope of the present invention. It is noted that, for the sake of explanation, a vertical direction in a state where an image forming apparatus 10 is usably installed (the state shown in FIG. 1), is defined as an up-down direction D1. In addition, a front-rear direction D2 and a left-right direction D3 are defined in the state where the image forming apparatus 10 is usably installed.

The image forming apparatus 10 according to the present embodiment of the present invention has at least a print function. The image forming apparatus 10 is, for example, a tandem-type color printer.

Figure 1:
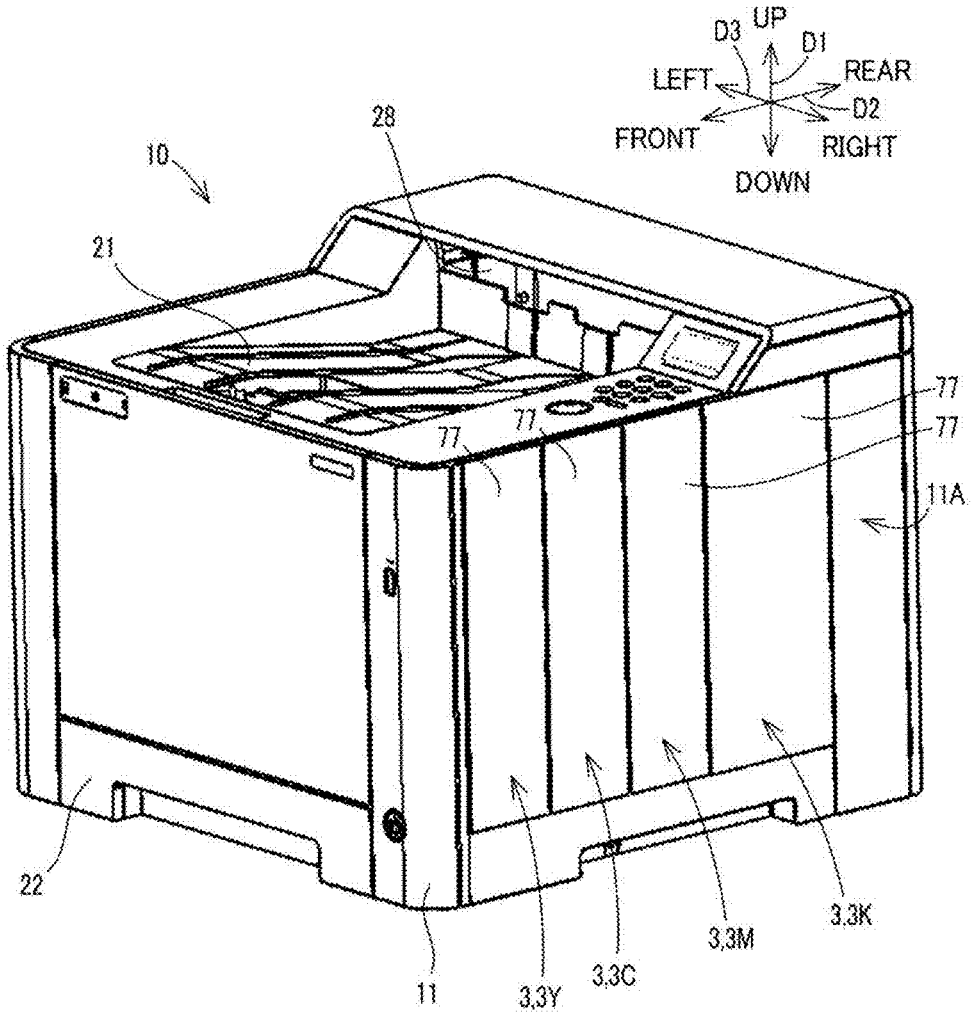
FIG. 1 is a perspective diagram showing a configuration of an image forming apparatus according to an embodiment of the present invention.
Figure 2:
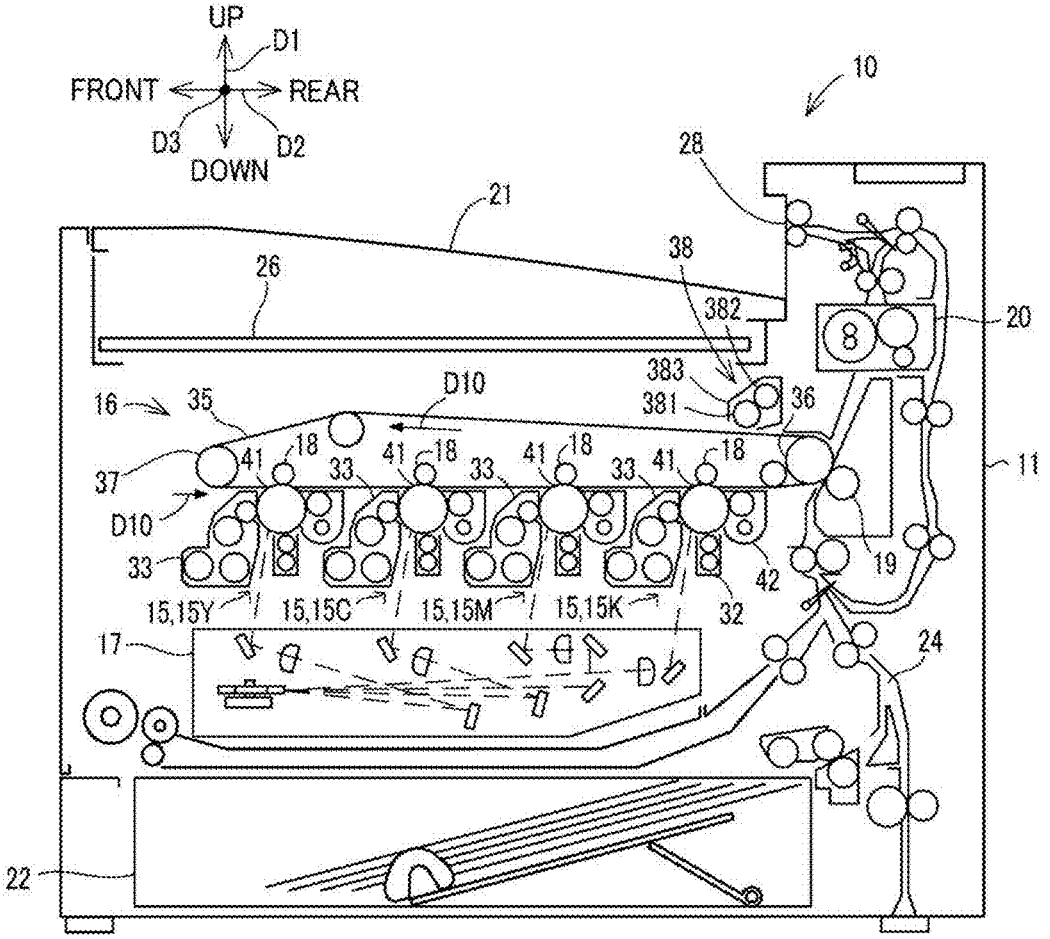
FIG. 2 is a cross-sectional diagram showing an internal configuration of the image forming apparatus.

As shown in FIG. 1 and FIG. 2, the image forming apparatus 10 includes a housing 11 (an example of an apparatus main body of the present invention). The housing 11 has an approximately parallelepiped shape as a whole. Some of the components constituting the image forming apparatus 10 are stored in the housing 11.

As shown in FIG. 2, the image forming apparatus 10 includes a plurality of image forming units 15 (15Y, 15C, 15M, and 15K), an intermediate transfer unit 16, a laser scanning unit 17, a primary transfer roller 18, a secondary transfer roller 19, a fixing device 20, a sheet tray 21, the sheet feed cassette 22, a conveyance path 24, and a control portion 26 configured to control components of the image forming apparatus 10. In addition, as shown in FIG. 1, the image forming apparatus 10 includes a plurality of toner containers 3 (an example of a toner container of the present invention) attached to the inside of the housing 11 in a detachable manner.

The image forming apparatus 10 includes four image forming units 15. The image forming units 15 form toner images by an electrophotographic method. Each of the image forming units 15 includes a photoconductor drum 41, a drum cleaning device 42, a charging device 32, and a developing device 33. It is noted that in FIG. 2, some reference signs "32" and "42" are omitted for want of space.

As shown in FIG. 2, the image forming units 15 are arranged in alignment along the front-rear direction D2 in the housing 11, and form a color image based on what is called a tandem system. Specifically, the image forming unit 15Y is configured to form a toner image of yellow, and the image forming units 15C, 15M and 15K form toner images of cyan, magenta and black, respectively. The image forming units 15Y for yellow, 15C for cyan, 15M for magenta, and 15K for black are arranged in alignment in the stated order from front to rear along the running direction (the direction indicated by the arrow D10) of a transfer belt 35 of the intermediate transfer unit 16.

The photoconductor drum 41 has a cylindrical shape and carries a toner image developed by the developing device 33. The photoconductor drum 41 is rotatably supported by the housing 11 or the like.

In each of the image forming units 15, the charging device 32 uniformly charges the photoconductor drum 41 to a certain potential. Subsequently, the laser scanning unit 17 irradiates a laser beam on the surface of the photoconductor drum 41 based on the image data. In this processing, electrostatic latent images are formed on the respective surfaces of the photoconductor drums 41. The electrostatic latent images are developed by the developing devices 33 as the toner images. The toner images of the respective colors on the surfaces of the photoconductor drums 41 are transferred to the transfer belt 35 by the primary transfer rollers 18 such that the toner images are overlaid with each other in sequence. Next, the color image on the transfer belt 35 is transferred by the secondary transfer roller 19 to a print sheet. The color image transferred to the print sheet is fixed to the print sheet by the fixing device 20, and thereafter, the print sheet is discharged from a sheet discharge port 28 to the sheet tray 21.

The drum cleaning device 42 is configured to remove, by a cleaning blade, toner that has remained on the photoconductor drum 41 after the primary transfer. The drum cleaning device 42 is provided on the rear side of each photoconductor drum 41. The tip of the cleaning blade is disposed so as to be in contact with or close to the surface of the photoconductor drum 41. When the photoconductor drum 41 is rotated, the cleaning blade removes toner that has remained on the surface of the photoconductor drum 41 after the transfer. In general, the removed toner is referred to as "waste toner" since it is to be discarded. A spiral member is a toner conveyance member having a spiral blade around a rotation shaft. The spiral member is driven to rotate so as to convey the waste toner removed by the cleaning blade. The waste toner is conveyed toward one side (in the present embodiment, the right side) in the axial direction (longitudinal direction) of the photoconductor drum 41.

As shown in FIG. 1, a plurality of toner containers 3 (3Y, 3C, 3M and 3K) are attached to the image forming apparatus 10. The plurality of toner containers 3 are attached to a right side surface 11A (an example of a first surface of the present invention) of the housing 11 of the image forming apparatus 10. In the present embodiment, the four toner containers 3 are attached to the right side surface 11A in a state of being aligned along the front-rear direction D2, wherein a toner container 3Y is disposed at the front-most position, and a toner container 3K for black is disposed at the rear-most position.

Figure 3:
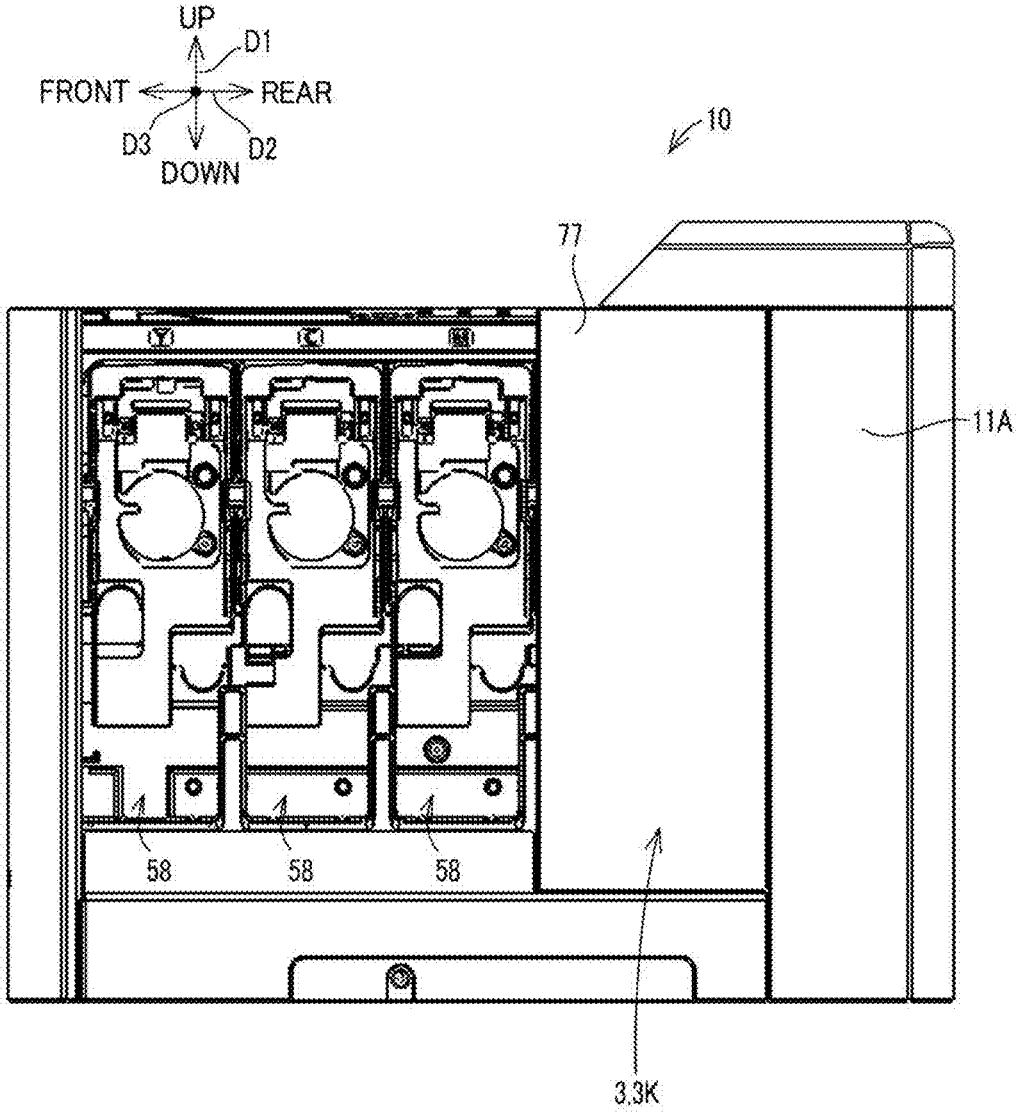
FIG. 3 is a diagram of the image forming apparatus viewed from the right side.

FIG. 3 is a side diagram of the image forming apparatus 10 viewed from the right side, showing a state where the toner containers 3 other than the toner container 3K have been detached therefrom. As shown in FIG. 3, attachment portions 58 for supporting the toner containers 3 that are attached thereto in a detachable manner, are provided inside the right side surface 11A of the housing 11. It is noted that although FIG. 3 shows only attachment portions 58 to which the toner containers 3Y, 3C, and 3M are to be attached, an attachment portion 58 corresponding to the toner container 3K is also provided in the housing 11.

Each of the toner containers 3 includes an upper storage portion 71 (a first toner storage portion) and a lower storage portion 72 (a second toner storage portion). The upper storage portion 71 includes, inside thereof, a storage space storing unused toner for supply. The lower storage portion 72 includes, inside thereof, a storage space for storing the waste toner discharged from the drum cleaning device 42. In the state where the toner containers 3 are attached to the attachment portions 58, the unused toner is supplied to the inside of the developing devices 33 from the upper storage portions 71 of the toner containers 3. In addition, the waste toner discharged from the drum cleaning devices 42 passes through discharge guide portions (not shown), and is guided to and stored in the lower storage portions 72 of the toner containers 3.

As shown in FIG. 3, the four toner containers 3 are attached to the right side surface 11A of the housing 11 on the right side of the image forming units 15. The toner containers 3 are arranged in alignment along the front-rear direction D2 at the right side surface 11A of the housing 11. The toner containers 3 are described in detail below.

As shown in FIG. 2, the intermediate transfer unit 16 is provided above the four image forming units 15. More specifically, the intermediate transfer unit 16 is provided above the photoconductor drums 41. The intermediate transfer unit 16 includes the transfer belt 35, a driving roller 36, a driven roller 37, and a belt cleaning device 38. It is noted that the primary transfer roller 18 is supported by a frame (not shown) of the intermediate transfer unit 16.

The transfer belt 35 is an annular belt member, and is suspended between the driving roller 36 and the driven roller 37 to extend in the front-rear direction D2. A plurality of drum units 31 are arranged in alignment in the front-rear direction D2 along the transfer belt 35. The transfer belt 35 holds, on its surface, toner images primarily transferred from the photoconductor drums 41. When the transfer belt 35 is rotationally driven to move in a direction indicated by the arrow D10, the toner images of respective colors carried by the photoconductor drums 41 are transferred in sequence onto the transfer belt 35 such that the toner images are overlaid with each other.

The belt cleaning device 38 is provided in the vicinity of the fixing device 20. Specifically, the belt cleaning device 38 is provided above the transfer belt 35 on the rear side of the housing 11. Below the belt cleaning device 38, the image forming unit 15K for black is disposed. That is, the belt cleaning device 38 is located closest to the image forming unit 15K for black among the plurality of image forming units 15.

The belt cleaning device 38 is configured to remove used toner that has remained on the surface of the transfer belt 35, and convey the removed used toner (hereinafter referred to as "waste toner") toward the lower storage portion 72 of the toner container 3K via a toner discharge path (not shown) of the drum cleaning device 42 for black. The belt cleaning device 38 includes a cleaning roller 381 that is elongated in the left-right direction D3, a spiral member 382 as a conveyance member for conveying the waste toner, and a housing 383 for storing these components (see FIG. 2). The cleaning roller 381 is configured to remove the used toner from the surface of the transfer belt 35 by rotating while in contact with the surface of the transfer belt 35. The used toner (waste toner) thus removed is conveyed in a certain direction by the spiral member 382 that is rotating. Specifically, the waste toner is conveyed toward one side (in the present embodiment, the right side) of the width direction (that matches the left-right direction D3) of the transfer belt 35.

In the belt cleaning device 38, the waste toner that has been conveyed to the right end of the housing 383 by the spiral member 382 is conveyed along the toner discharge path to be guided to and stored in the lower storage portion 72 of the toner container 3K.

Meanwhile, in conventional image forming apparatuses, when a toner container 3 is replaced with another one, a cover attached to a top surface or a side surface of the apparatus is opened. The cover is supported by the apparatus main body in such a way as to pivot around a hinge or the like. Therefore, like a door, the cover needs to be pivoted around the hinge. In this case, it is necessary to ensure a large space at the top surface or the side surface of the apparatus main body so that at least the cover can pivot when the toner container 3 is replaced. This poses a problem of restricting the installment space of the image forming apparatus.

On the other hand, according to the image forming apparatus 10 of the present embodiment, the toner container 3 is provided with an exterior panel 77 (see FIG. 4), and the attachment portion 58 is configured as described below. This makes it possible to reduce the space necessary for replacement of the toner container 3 as compared with a conventional one, and improve the freedom of setting the image forming apparatus 10.

The following describes the configuration of the toner container 3Y as a representative of the four toner containers 3. It is noted that the toner containers 3C and 3M have the same configuration as the toner container 3Y, and the toner container 3K has the same configuration as the toner container 3Y except that it has a larger capacity, and thus detailed description of the toner containers 3C, 3M, and 3K is omitted here.

Figure 4:
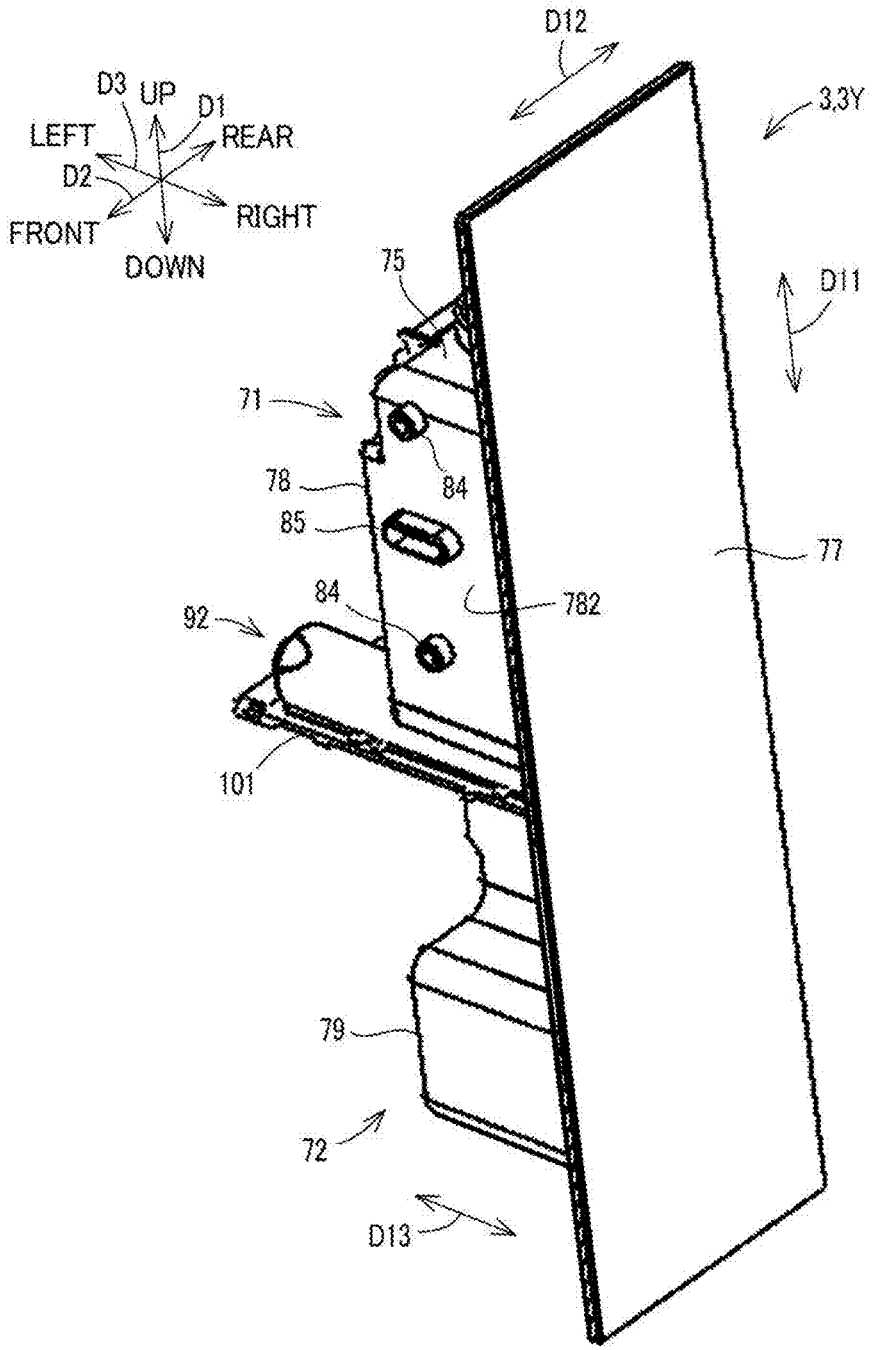
FIG. 4 is a perspective diagram of a toner container viewed from an exterior panel side.
Figure 5:
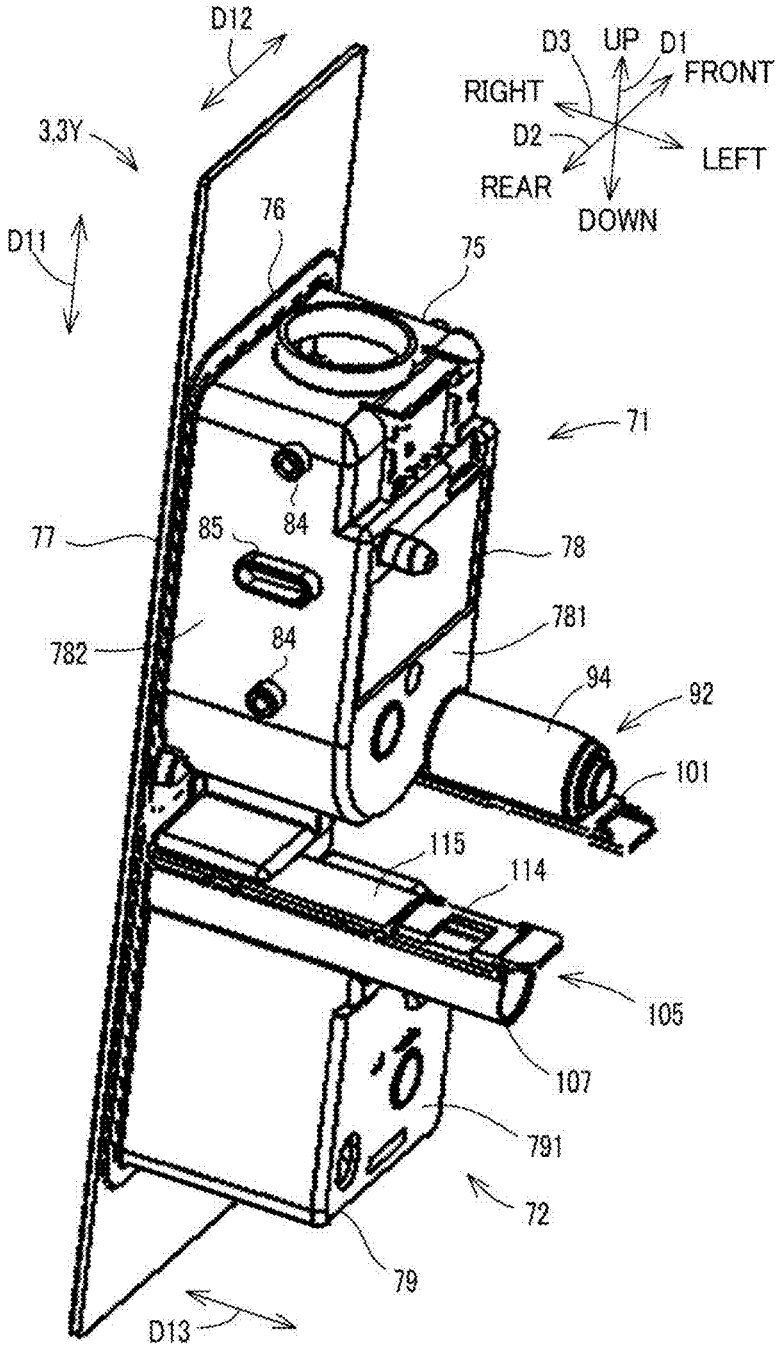
FIG. 5 is a perspective diagram of the toner container viewed from a container main body side.

FIG. 4 is a perspective diagram of the toner container 3Y viewed from the exterior panel 77 side. FIG. 5 is a perspective diagram of the toner container 3Y viewed from a container main body 75 side. It is noted that in FIG. 4 and FIG. 5, the up-down direction D1, the front-rear direction D2, and the left-right direction D3 are shown based on an attachment attitude of the toner container 3Y attached to the attachment portion 58 (see FIG. 3). In addition, in the following description, with respect to the toner container 3Y in the attachment attitude, the up-down direction D1 is defined as a height direction D11 of the toner container 3Y, the front-rear direction D2 is defined as a width direction D12 of the toner container 3Y, and the left-right direction D3 is defined as a depth direction D13 of the toner container 3Y.

As shown in FIG. 4 and FIG. 5, the toner container 3Y includes the container main body 75. The container main body 75 is a resin molding product molded with a synthetic resin by injection molding. The container main body 75 is formed to be elongated in the height direction D11, wide in the width direction D12, and shallow in the depth direction D13.

The container main body 75 includes an upper case 78 (first housing) formed at an upper position of the container main body 75, a lower case 79 (second housing) formed at a lower position of the container main body 75, a lid 76 (see FIG. 5, lid member), and the exterior panel 77 (an example of an exterior member of the present invention). That is, the upper case 78 is formed on one side (upper side) in the height direction D11 (longitudinal direction) of the container main body 75, and the lower case 79 is formed on the other side (lower side) in the height direction D11 of the container main body 75.

An opening portion is formed in the right side surface of each of the upper case 78 and the lower case 79. The opening portions are formed on the same plane. A flange is formed at an opening edge of each of the opening portions. Each of the opening portions is closed by the lid 76 (see FIG. 5) of a flat plate shape. For example, the lid 76 and the flange are welded to each other. The upper storage portion 71 having a storage space for storing the unused toner is formed when the opening portion of the upper case 78 is closed with the lid 76. In addition, the lower storage portion 72 having a storage space for storing the waste toner is formed when the opening portion of the lower case 79 is closed with the lid 76.

As shown in FIG. 5, the upper storage portion 71 includes a first conveyance portion 92. The first conveyance portion 92 includes a cylindrical first conveyance guide portion 94 and a spiral member (not shown), wherein the first conveyance guide portion 94 extends outward from a left wall surface 781 of the upper case 78, and the spiral member is provided inside the first conveyance guide portion 94 and functions as a toner conveying member. The first conveyance guide portion 94 is integrally formed with the upper case 78, and has the shape of a cylinder whose center is the same as a rotation center of the spiral member. Here, the wall surface 781 is located on one side in the depth direction D13 of the toner container 3Y with respect to the attachment portion 58, and faces the attachment portion 58 when the toner container 3Y is attached to the attachment portion 58. It is noted that the depth direction D13 matches the attachment/detachment direction of the toner container 3Y with respect to the attachment portion 58.

The spiral member has a spiral blade formed around an axis of a rotation shaft, and is rotatably provided inside the first conveyance guide portion 94. An input portion is integrally formed with a tip of the rotation shaft, the input portion receiving a rotational driving force that is input from outside. Upon being rotated by the rotational driving force received from the input portion, the spiral member conveys the unused toner from the inside of the upper storage portion 71 to the attachment portion 58 side (see FIG. 4) through the inside of the first conveyance guide portion 94, and guides the unused toner to the developing device 33 through a toner discharge port (not shown).

In addition, on the lower surface of the first conveyance guide portion 94, a shutter member 101 (opening and closing member) for opening and closing the toner discharge port is provided. The shutter member 101 is supported by the first conveyance guide portion 94 in such a manner that the shutter member 101 can slide on the lower surface of the first conveyance guide portion 94 in the longitudinal direction of the first conveyance guide portion 94. When the toner container 3Y is attached to the attachment portion 58 (see FIG. 3), the shutter member 101 is moved from a closing position of closing the toner discharge port, to an opening position of opening the toner discharge port. With this configuration, the toner discharge port is connected to a supply port of the developing device 33, and the toner can be supplied from the toner discharge port to the supply port.

As shown in FIG. 5, the lower storage portion 72 includes a second conveyance portion 105. The second conveyance portion 105 conveys waste toner discharged from the drum cleaning device 42 of a corresponding color of toner, to the inside of the lower storage portion 72. The second conveyance portion 105 includes a cylindrical second conveyance guide portion 107 and a spiral member (not shown), wherein the second conveyance guide portion 107 extends outward from a left wall surface 791 of the lower case 79, and the spiral member is provided inside the second conveyance guide portion 107 and functions as a toner conveying member. The second conveyance guide portion 107 is integrally formed with the lower case 79, and has the shape of a cylinder whose center is the same as a rotation center of the spiral member.

The spiral member is a conveyance member for conveying the waste toner that has been discharged from the drum cleaning device 42 to the second conveyance guide portion 107, to the inside of the lower storage portion 72 through the second conveyance guide portion 107. In addition, the second conveyance guide portion 107 is a guide member for receiving the waste toner from the drum cleaning device 42 and guiding the waste toner conveyed by the spiral member, to the inside of the lower storage portion 72.

The spiral member has a spiral blade formed around an axis of a rotation shaft. The spiral member is rotatably provided in the second conveyance guide portion 107. A tip of the rotation shaft is integrally formed with an input portion configured to receive a rotational driving force that is input from outside. Upon being rotated by the rotational driving force received from the input portion, the spiral member conveys the waste toner in the second conveyance guide portion 107 toward the inside of the lower storage portion 72.

In addition, a toner inlet 114 for guiding the waste toner to the inside of the second conveyance guide portion 107 is formed on the upper surface of the second conveyance guide portion 107. In addition, on the upper surface of the second conveyance guide portion 107, a shutter member 115 for opening and closing the toner inlet 114 is provided. The shutter member 115 is supported by the second conveyance guide portion 107 such that the shutter member 115 can slide on the upper surface of the second conveyance guide portion 107 in the longitudinal direction of the second conveyance guide portion 107. When the toner container 3Y is attached to the attachment portion 58 (see FIG. 3), the shutter member 115 is moved from a closing position of closing the toner inlet 114, to an opening position of opening the toner inlet 114. This allows the toner inlet 114 to be connected to the toner discharge port of the drum cleaning device 42 so that the waste toner can be introduced from the toner discharge port into the toner inlet 114.

As shown in FIG. 4, the exterior panel 77 is a rectangular flat plate member elongated in the height direction D11. The exterior panel 77 is made of the same material as the housing 11 of the image forming apparatus 10, and, for example, has the same color as the housing 11. The exterior panel 77 is larger than the lid 76 (see FIG. 6) in size, and is attached to an outer surface of the lid 76. The surface of the exterior panel 77 is flat, and on the surface, no member for operating or grasping the toner container 3Y is provided. In the present embodiment, as shown in FIG. 3, in an attachment state where the toner container 3Y is attached to the attachment portion 58, the exterior panel 77 of the toner container 3Y constitutes a part of the exterior of the right side surface 11A of the housing 11.

As shown in FIG. 4 and FIG. 5, two projecting bosses 84 are formed on each of side surfaces 782 of the upper case 78 that are opposite to each other in the width direction D12, wherein the two projecting bosses 84 are separated from each other in the height direction D11. The projecting bosses 84 are an example of an engaging piece of the present invention. The projecting bosses 84 are integrally formed with the upper case 78. Two projecting bosses 84 are formed on the side surface 782 of the front side, and two projecting bosses 84 are formed on the side surface 782 of the rear side. When the toner container 3Y is attached to a predetermined attachment position in the attachment portion 58, the projecting bosses 84 are engaged with hooks 652 included in a moving frame 65 that is described below and the projecting bosses 84 are locked in the attachment/detachment direction of the toner container 3Y with respect to the attachment portion 58. Specifically, in the state where the toner container 3Y is attached to the attachment portion 58, the projecting bosses 84 are hooked and engaged with lock grooves 657 of the hooks 652 that are described below, and the projecting bosses 84 are locked in the attachment/detachment direction. It is noted that the attachment/detachment direction matches the left-right direction D3, is perpendicular to the right side surface 11A of the housing 11, and corresponds to a first direction of the present invention.

On each of the side surfaces 782 of the upper case 78, an elongated boss 85 is formed to project therefrom. The elongated boss 85 is elongated in the depth direction D13. One elongated boss 85 is formed on the side surface 782 of the front side, and one elongated boss 85 is formed on the side surface 782 of the rear side. On each side surface 782, the elongated boss 85 is located approximately in the middle of the two projecting bosses 84 that are separated from each other in the height direction D11. The projecting bosses 84 are provided so that when the toner container 3Y is attached to the predetermined attachment position in the attachment portion 58, the toner container 3Y is positioned in the up-down direction D1 in the attachment portion 58. Specifically, in the state where the toner container 3Y is attached to the attachment portion 58, the elongated boss 85 is inserted in a positioning groove 614 formed in a support frame 61 described below such that the elongated boss 85 is positioned in the up-down direction D1.

The following describes a configuration of the attachment portions 58 to which the toner containers 3 are attached. It is noted that in the present embodiment, four attachment portions 58 are provided in correspondence with the four toner containers 3, and the four attachment portions 58 have the same configuration.

Figure 6:
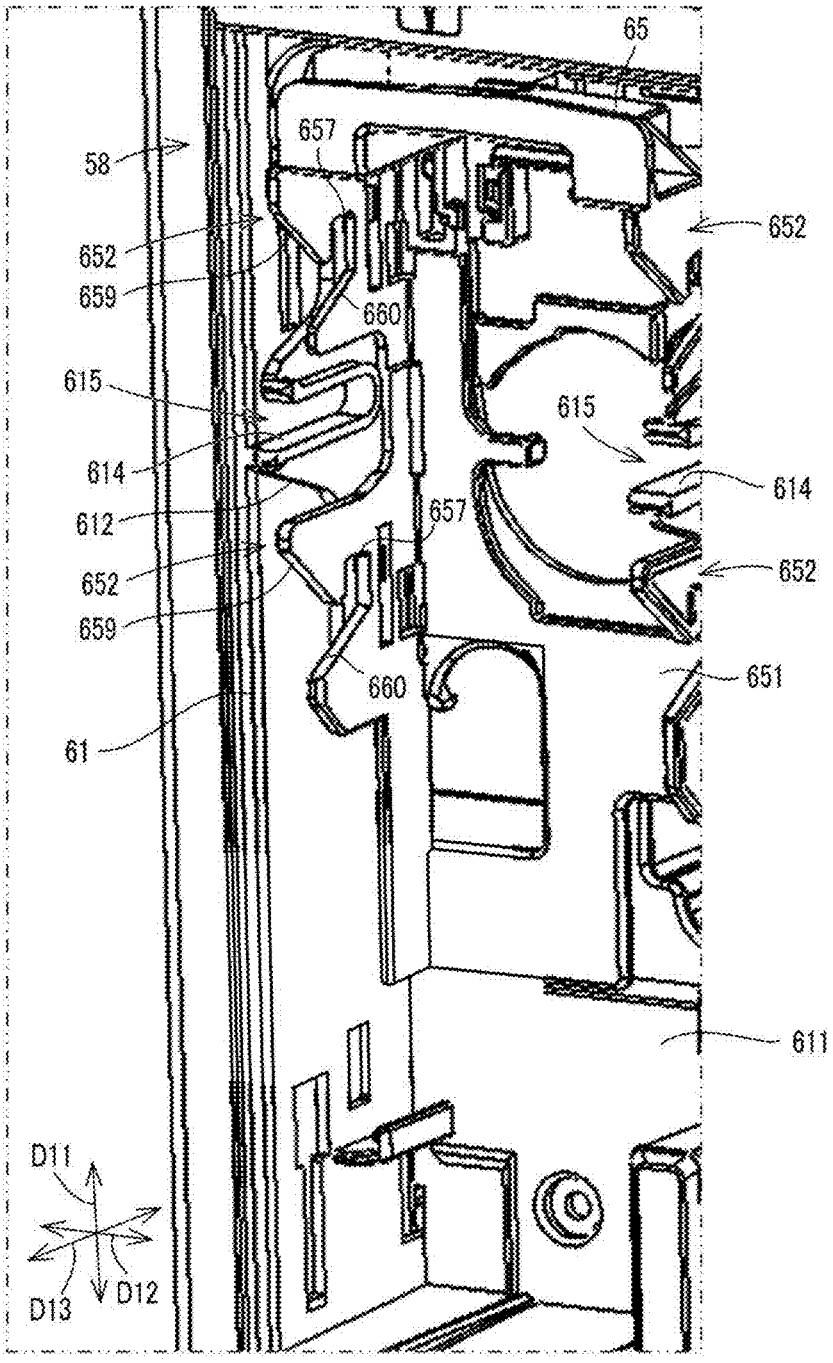
FIG. 6 is an enlarged perspective diagram showing an attachment portion to which the toner container is attached.
Figure 7:
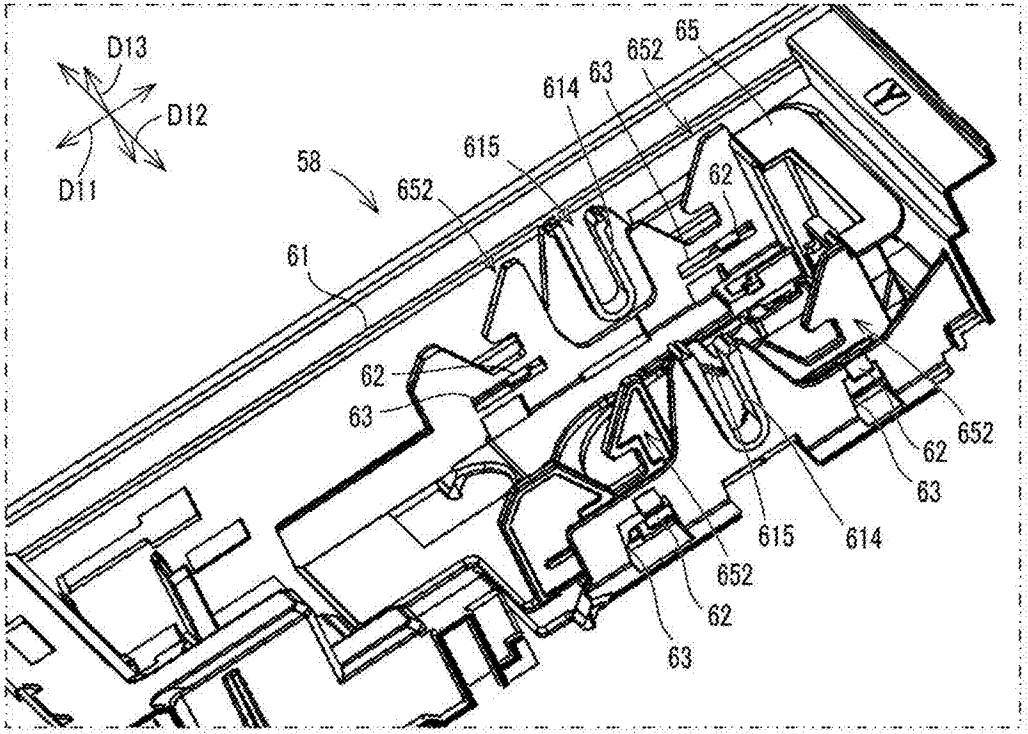
FIG. 7 is a perspective diagram showing a state where a moving member is located at a lock position in the attachment portion.
Figure 8:
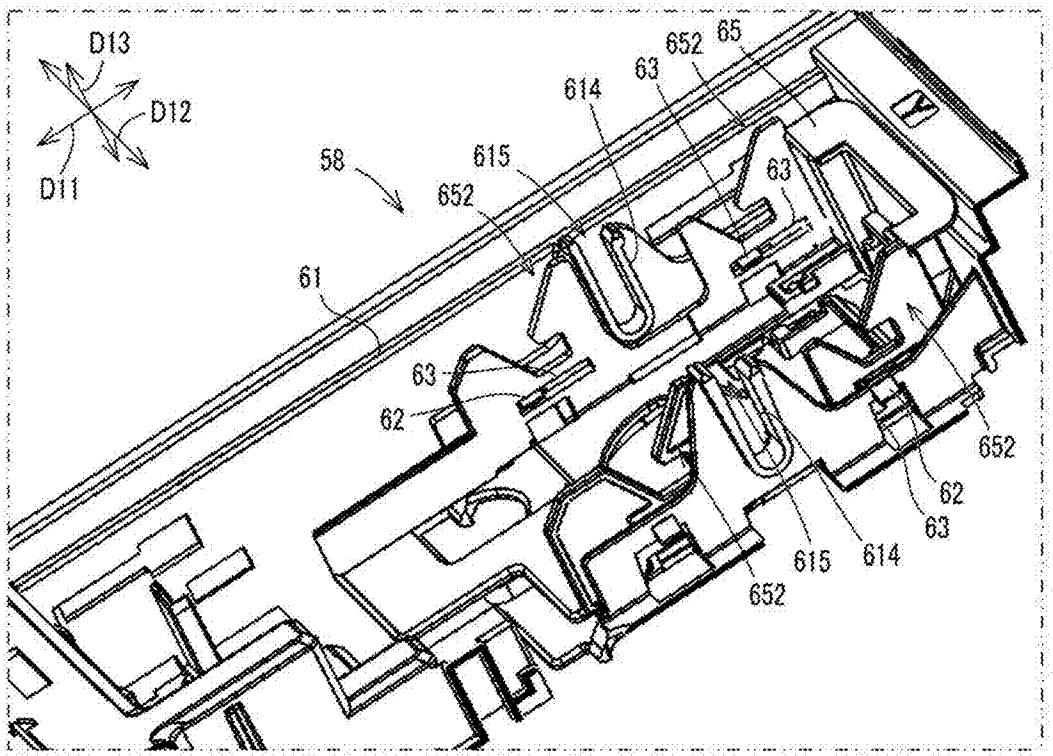
FIG. 8 is a perspective diagram showing a state where the moving member is located at an unlock position in the attachment portion.

FIG. 6 is an enlarged perspective diagram showing an attachment portion 58 to which a toner container 3 is attached. FIG. 7 and FIG. 8 are perspective diagrams showing how a moving frame 65 is arranged in the attachment portion 58. FIG. 7 shows a state where the moving frame 65 is arranged at a lock position to lock the toner container 3, and FIG. 8 shows a state where the moving frame 65 is arranged at an unlock position (a removal position) to remove the lock of the toner container 3.

Figure 13:
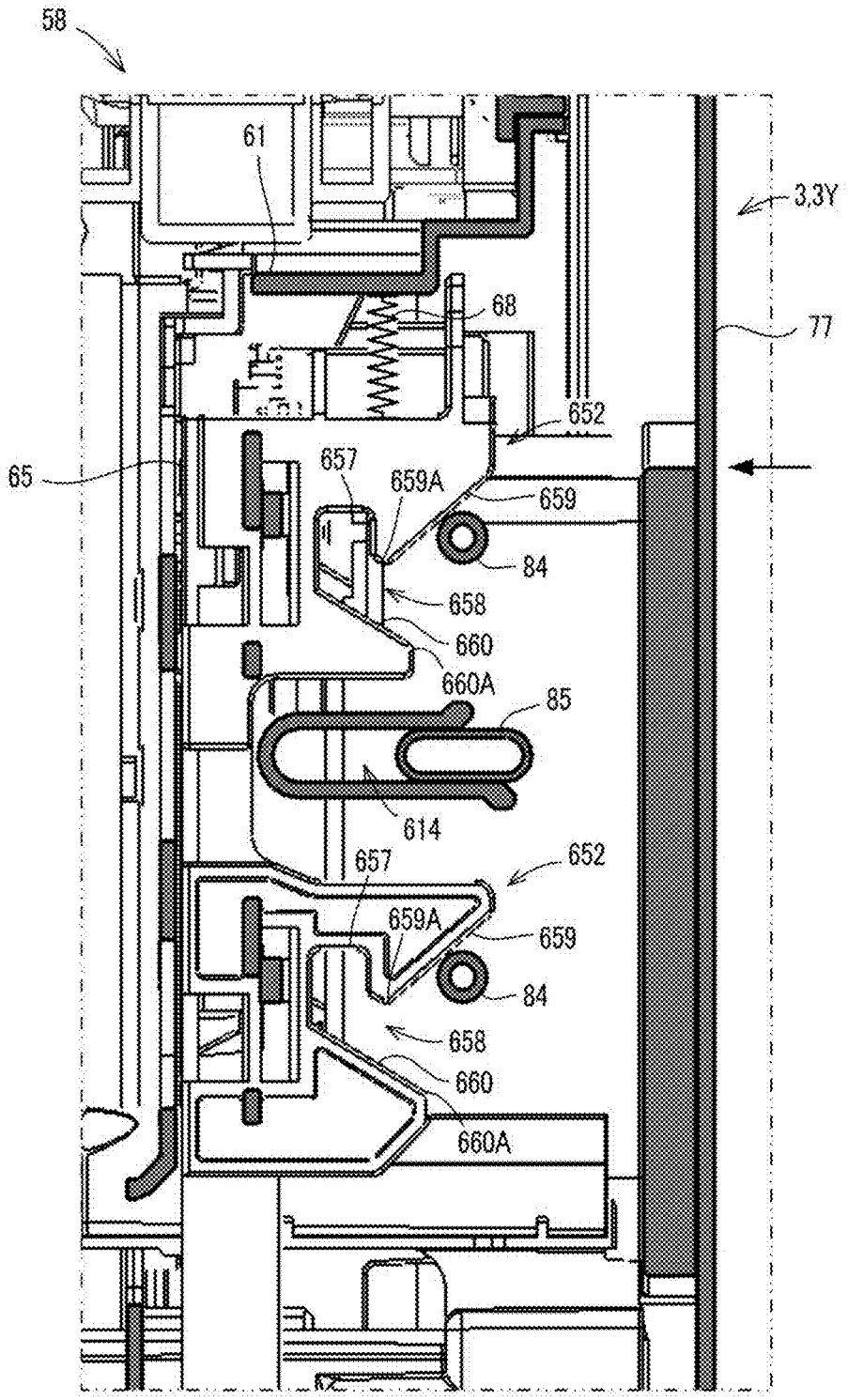
FIG. 13 is a side diagram showing a positional relationship between the toner container and the support frame and an engagement relationship between the moving frame and a cam, wherein the toner container is located at the detachment position.
Figure 15:
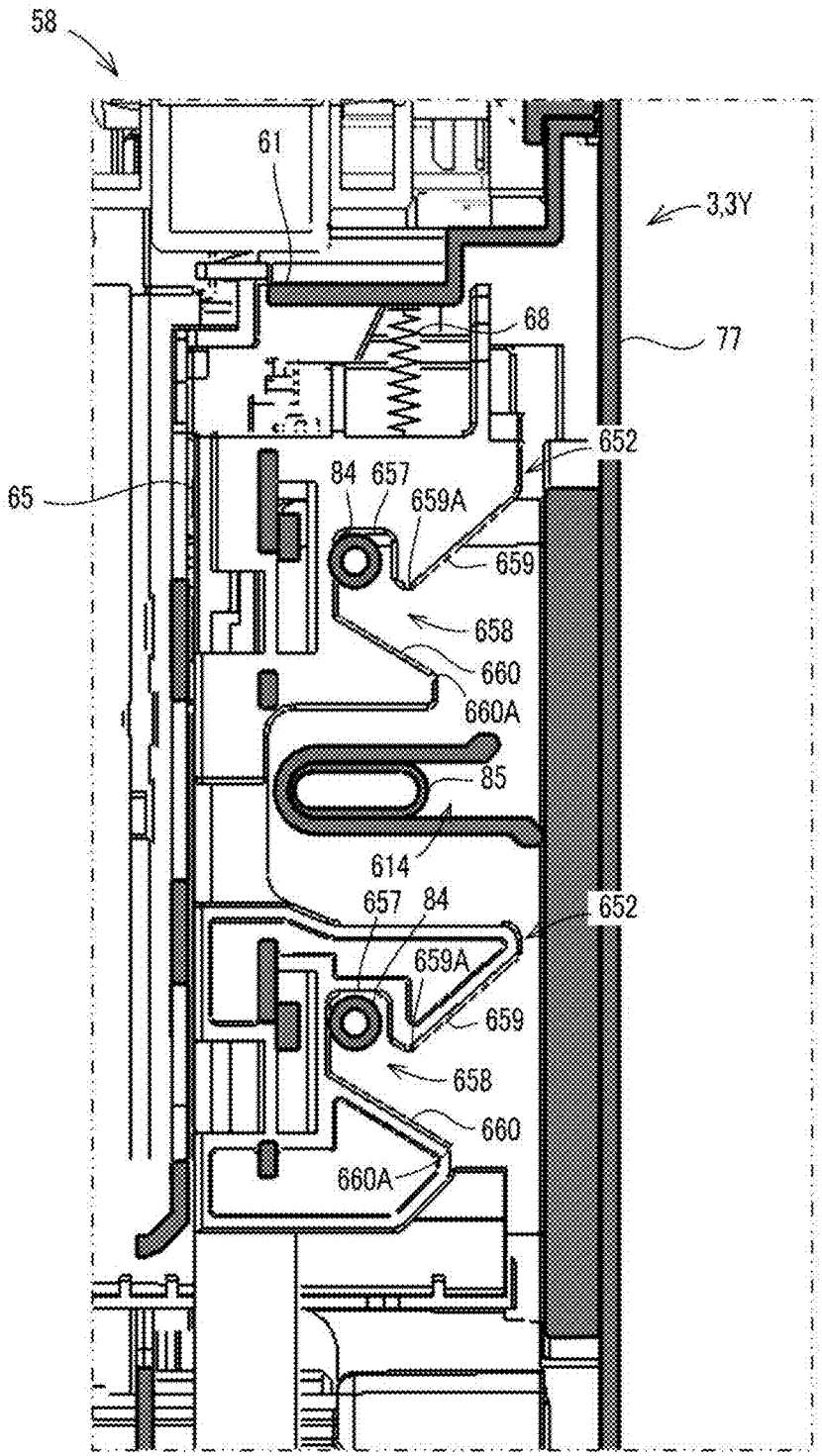
FIG. 15 is a side diagram showing a positional relationship between the toner container and the support frame and an engagement relationship between the moving frame and the cam, showing a state where the toner container is located at the attachment position and locked.

The attachment portion 58 supports the toner container 3 so that the toner container 3 can be moved between the predetermined attachment position and a predetermined detachment position. In addition, the attachment portion 58 is configured to hold the toner container 3 in the state where the toner container 3 is locked to the attachment position. Here, the attachment position is provided inside the right side surface 11A of the housing 11, and is shown in FIG. 15. In addition, the detachment position is separated from the attachment position toward the right side surface 11A by a predetermined distance, and is shown in FIG. 13.

As shown in FIG. 6, the attachment portion 58 includes the support frame 61 (an example of a support member of the present invention), the moving frame 65 (an example of a lock member of the present invention), and a coil spring 68 (an example of an elastic member of the present invention). These members are, for example, made of a synthetic resin.

Figure 9:
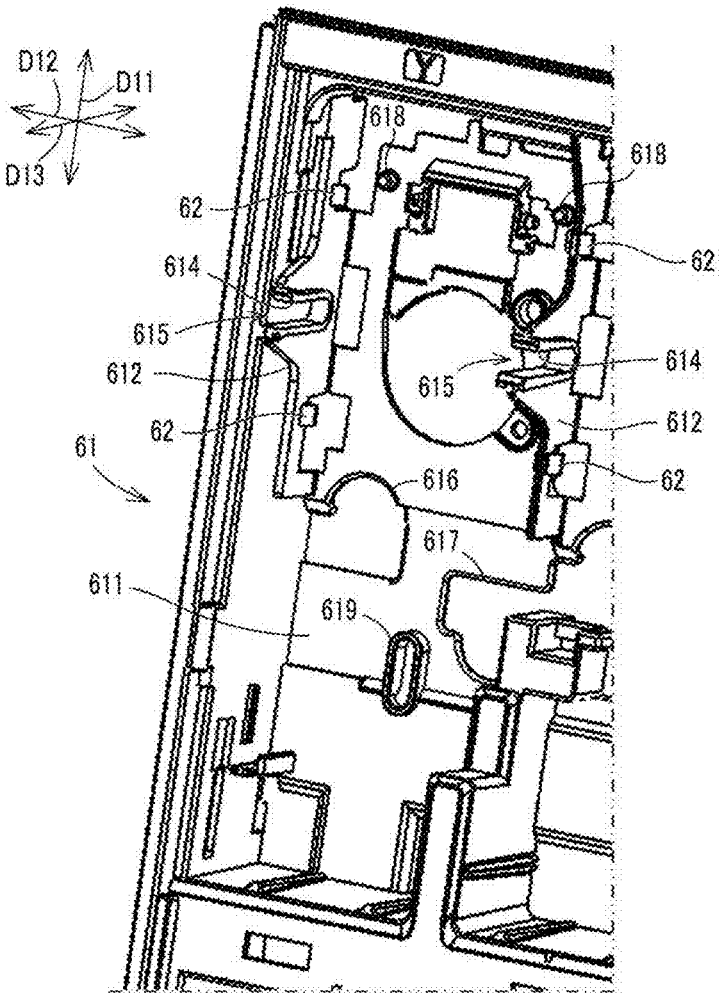
FIG. 9 is an enlarged perspective diagram showing a main part of a support frame of the attachment portion.
Figure 10:
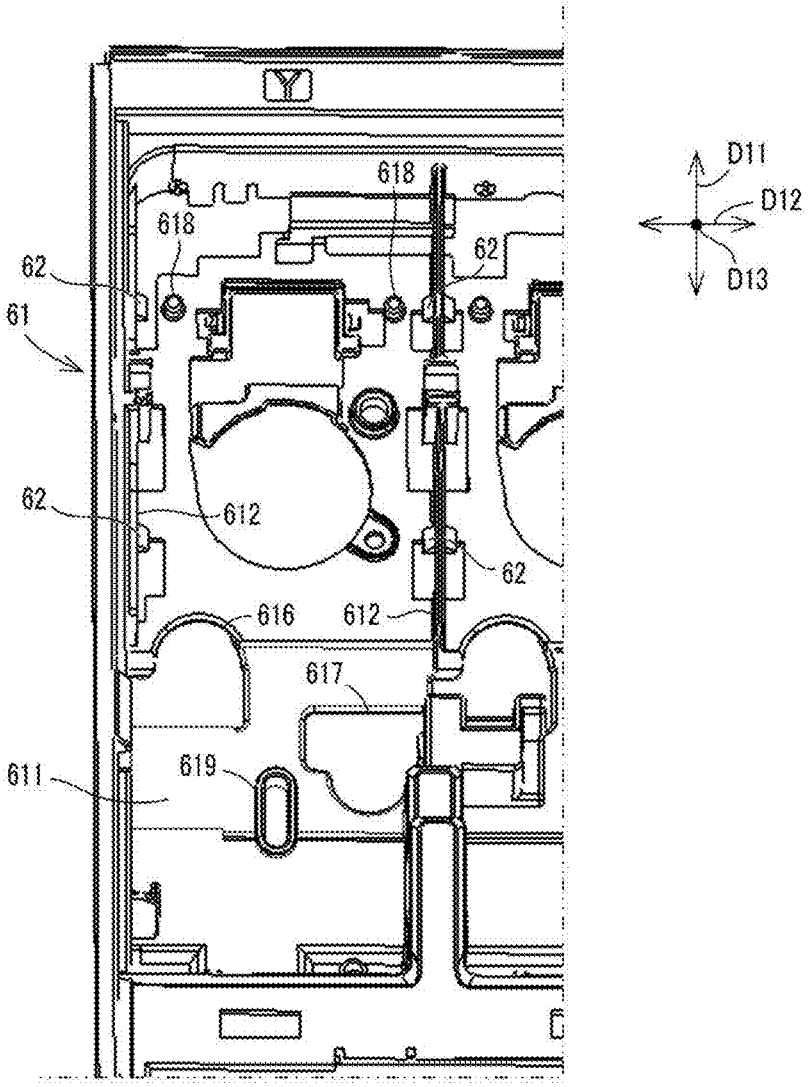
FIG. 10 is an enlarged diagram showing the main part of the support frame of the attachment portion.

The support frame 61 is fixed to an internal frame of the housing 11. The support frame 61 supports the toner container 3 so that the toner container 3 can move between the attachment position and the detachment position. FIG. 9 shows a state where the moving frame 65 has been removed from the attachment portion 58, and shows a configuration of the support frame 61. As shown in FIG. 9, the support frame 61 includes a bottom plate 611 and side plates 612, wherein the moving frame 65 is disposed on the bottom plate 611, and the side plates 612 are erected from opposite ends of the bottom plate 611 that are opposite to each other in the width direction D12.

Positioning grooves 614 are integrally formed in the inner surfaces of the side plates 612 such that the elongated bosses 85 of the toner container 3 are inserted in the positioning grooves 614. The positioning grooves 614 extend from projection ends of the side plates 612 in the depth direction D13, and have openings 615 at ends of the side plates 612 that are far away from the bottom plate 611 (at the upper side in FIG. 9). When the toner container 3 is attached to the attachment portion 58, the elongated bosses 85 are inserted in the positioning grooves 614 from the openings 615. This allows the elongated bosses 85 to be guided in the extension direction of the positioning grooves 614, allowing the toner container 3 to be moved between: the attachment position (a position shown in FIG. 14) where the elongated bosses 85 are disposed deep inside the positioning grooves 614; and the detachment position where the elongated bosses 85 are disposed closer to the openings 615 than to the attachment position.

In addition, when the elongated bosses 85 are inserted in the positioning grooves 614, the elongated bosses 85 are positioned in the up-down direction D1, and the toner container 3 is positioned in the up-down direction D1. This prevents a positional shift in the up-down direction D1. In addition, an opening 616 (see FIG. 9) and an opening 617 (see FIG. 9) are formed in the bottom plate 611, wherein the first conveyance portion 92 and the second conveyance portion 105 are respectively inserted in the opening 616 and the opening 617 when the toner container 3 is attached.

As shown in FIG. 6, the moving frame 65 is provided on the support frame 61. The moving frame 65 is supported by the support frame 61 in such a way as to be slidable in the height direction D11. The height direction D11 matches the up-down direction D1 in the state where the toner container 3 is attached to the attachment portion 58, and corresponds to a second direction of the present invention that extends along the right side surface 11A of the housing 11.

As shown in FIG. 9, engaging claws 62 are formed at some locations of the support frame 61. In addition, as shown in FIG. 7, long holes 63 that are elongated in the height direction D11 are formed at some locations of the moving frame 65 such that the engaging claws 62 are inserted in the long holes 63. When the engaging claws 62 are inserted in and engaged with the long holes 63, the moving frame 65 is supported by the support frame 61 in such a way as to be movable in the height direction D11. In addition, when the engaging claws 62 are engaged with edge portions of the long holes 63, the moving frame 65 is engaged with the support frame 61 in the depth direction D13.

Figure 12:
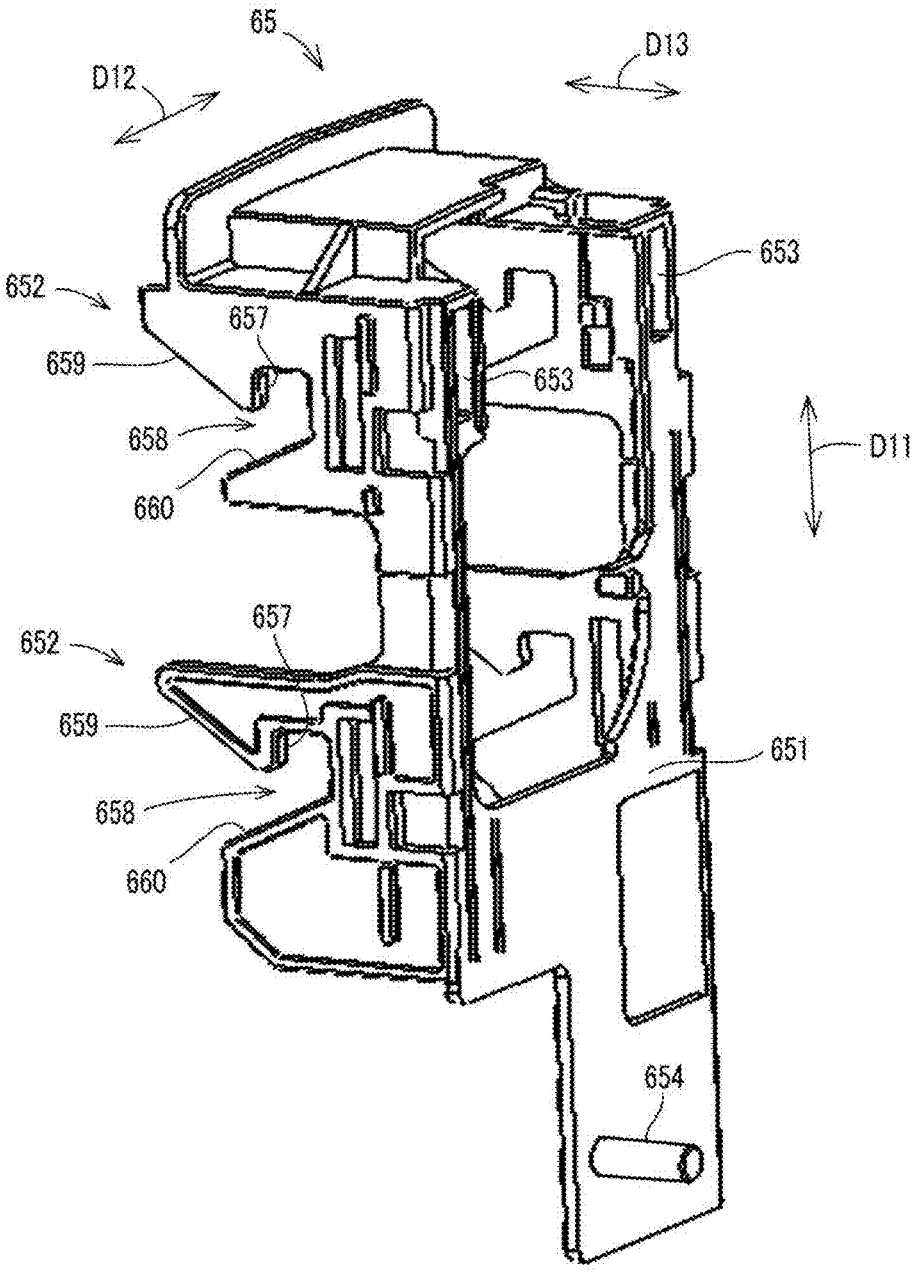
FIG. 12 is a perspective diagram showing the moving frame of the attachment portion.

As shown in FIG. 9, the bottom plate 611 of the support frame 61 is provided with a pair of bosses 618 that are separated from each other in the width direction D12. The pair of bosses 618 are projection-like members projecting from the bottom plate 611 and provided in an upper portion of the bottom plate 611. When the moving frame 65 is supported by the support frame 61, the bosses 618 are inserted in long holes 653 (see FIG. 12) formed in the moving frame 65. As shown in FIG. 12, the long holes 653 are formed to be elongated in the height direction D11 and are provided at positions that correspond to the bosses 618.

When the bosses 618 are inserted in the long holes 653, the moving frame 65 is positioned with respect to the support frame 61, and in particular, the moving frame 65 is restricted from being inclined with respect to the support frame 61.

In addition, the bottom plate 611 is provided with a long hole 619 (an example of a long hole of the present invention) that is elongated in the height direction D11. The long hole 619 is provided at a position lower than the pair of bosses 618 and is provided in a lower portion of the bottom plate 611. The long hole 619 is a through hole piercing through the bottom plate 611 in the depth direction. The long hole 619 is a portion in which a boss 654 (an example of a projection portion of the present invention; see FIG. 12) provided on the moving frame 65 is inserted when the moving frame 65 is supported by the support frame 61. As shown in FIG. 12, the boss 654 is a projection member projecting from a back surface of a base plate 651 and is provided at a position corresponding to the long hole 619. In a state where the boss 654 is inserted in the long hole 619, a tip portion of the boss 654 projects from the back surface of the base plate 651. When the boss 654 is inserted in the long hole 619, the boss 654 is guided along the height direction D11. In addition, the moving frame 65 is positioned with respect to the support frame 61 in the width direction D12, and thereby the moving frame 65 is restricted from being shifted with respect to the support frame 61 in the width direction D12.

It is noted that in the present embodiment, the boss 654 is pressed upward by a lock removing portion 120 (see FIG. 16) that is an example of a lock removing portion of the present invention, and thereby the moving frame 65 is moved from the lock position to the unlock position. A configuration of the lock removing portion 120 is described below.

The moving frame 65 is configured to move between the lock position shown in FIG. 7 and the unlock position shown in FIG. 8 in the support frame 61. When the moving frame 65 is at the lock position, the projecting bosses 84 of the toner container 3 are locked in the depth direction D13. In addition, when the moving frame 65 is at the unlock position, the lock of the projecting bosses 84 in the depth direction D13 is removed.

Figure 11:
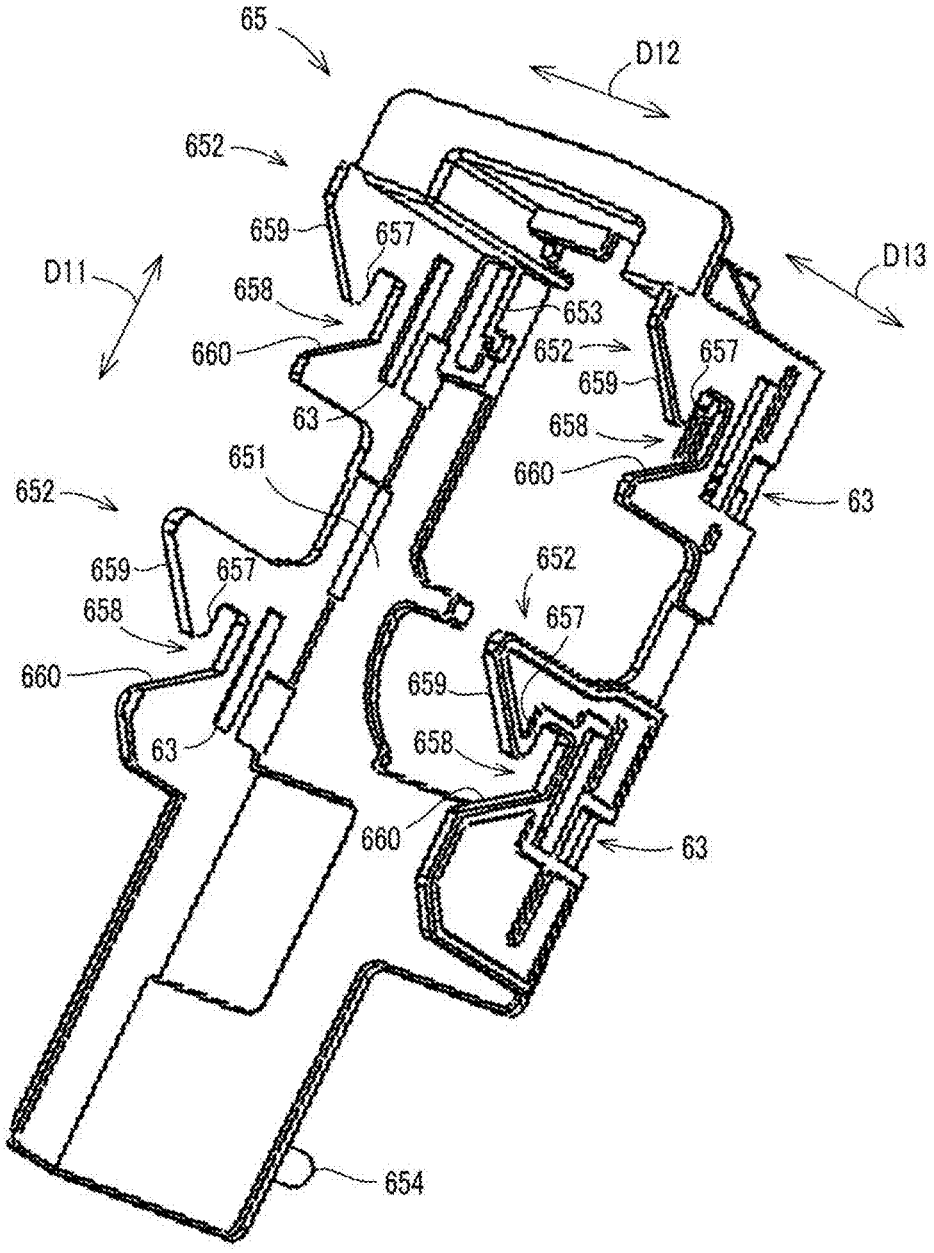
FIG. 11 is a perspective diagram showing a moving frame of the attachment portion.

FIG. 11 and FIG. 12 are perspective diagrams showing the moving frame 65 of the attachment portion 58. As shown in FIG. 11 and FIG. 12, the moving frame 65 includes the base plate 651 and the hooks 652 (an example of a hook portion of the present invention), wherein the base plate 651 is disposed to face the bottom plate 611 of the support frame 61, and the hooks 652 are downward hooks standing to project from opposite ends of the base plate 651 that are opposite to each other in the width direction D12. A plurality of openings are formed in the base plate 651 such that a plurality of portions such as the first conveyance portion 92 and the second conveyance portion 105 of the toner container 3 can be inserted in the openings.

The moving frame 65 includes four hooks 652. The four hooks 652 are respectively engaged with the four projecting bosses 84 of the toner container 3 in the depth direction in the state where the toner container 3 is attached to the attachment portion 58.

As shown in FIG. 11, each of the hooks 652 includes the lock groove 657 in which the projecting boss 84 is inserted when the toner container 3 is attached. The lock groove 657 extends in the height direction D11. Second cams 659 (an example of a second pressing portion of the present invention) are formed at projection ends of the hooks 652, wherein the second cams 659 are inclined toward the openings 658 of the lock grooves 657. When the toner container 3 is attached, the toner container 3 is pressed into the housing 11 from the right side surface 11A side with respect to the attachment portion 58, and in response to the pressing of the toner container 3, the second cams 659 press the moving frame 65 from the lock position (the position shown in FIG. 7) toward the unlock position (the position shown in FIG. 8).

The second cams 659 are inclined cams, and are inclined approximately 45 degrees. When the toner container 3 is inserted with respect to the attachment portion 58 in the attachment direction in a state where the toner container 3 has not been attached to the attachment portion 58, the projecting bosses 84 abut on the second cams 659.

In the present embodiment, the coil spring 68 is provided in the attachment portion 58. The coil spring 68 (see FIG. 12) elastically biases the moving frame 65 toward the lock position (downward) in a state where no other external force is applied to the moving frame 65. As shown in FIG. 13, the coil spring 68 is provided, in a compressed state, between an upper side wall of the support frame 61 and an upper side wall of the moving frame 65. With this configuration, in the state where no other external force is applied to the moving frame 65, the moving frame 65 is kept to be at the lock position.

Figure 14:
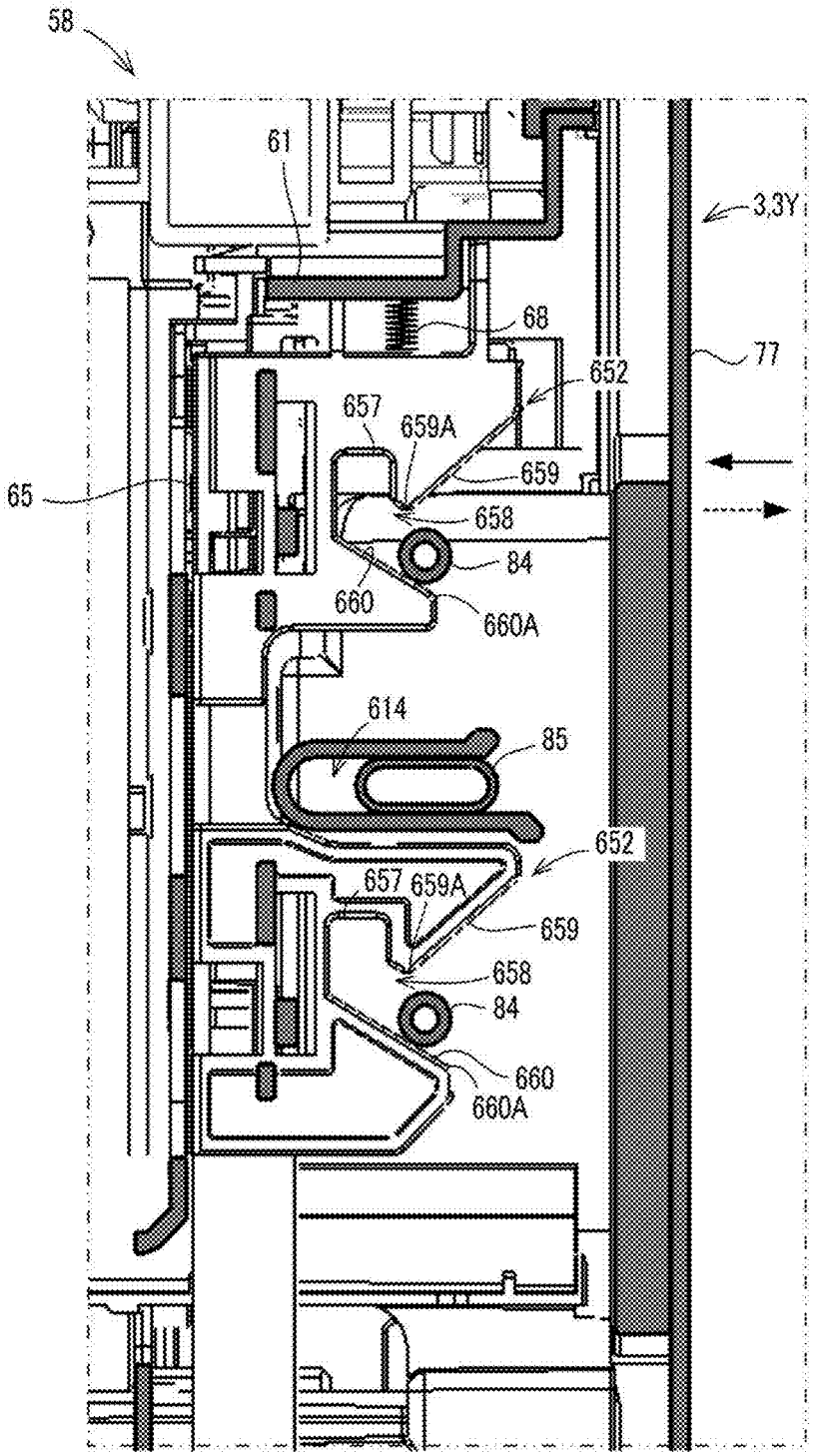
FIG. 14 is a side diagram showing a positional relationship between the toner container and the support frame and an engagement relationship between the moving frame and the cam, showing a state where the toner container has been pushed in from the detachment position toward an attachment position.

When the toner container 3 is attached, the projecting bosses 84 abut on the second cams 659, and when, in the state where the projecting bosses 84 abut on the second cams 659 (see FIG. 13), the toner container 3 is further inserted in a direction indicated by the solid line arrow of FIG. 13, the second cams 659 convert the pressing force in the insertion direction received from the projecting bosses 84, into a pressing force that moves the moving frame 65 downward (toward the unlock position). By the upward pressing force received by the second cams 659, the moving frame 65 moves from the lock position toward the unlock position against the biasing force of the coil spring 68. As shown in FIG. 14, during this movement process, the projecting bosses 84 reach the openings 658. When the toner container 3 is further inserted, the projecting bosses 84 abut on first cams 660 that are described below, and are guided into the lock grooves 657 by the first cams 660. The projecting bosses 84 then enter the lock grooves 657 through the openings 658. When the projecting bosses 84 enter the lock grooves 657, the engagement between the hooks 652 and the projecting bosses 84 is removed, and the moving frame 65 is returned from the unlock position to the lock position by the biasing force of the coil spring 68 (see FIG. 15). At this time, the projecting bosses 84 are locked to the hooks 652 in the depth direction D13. That is, as shown in FIG. 15, the toner container 3 is attached to the attachment portion 58 at the attachment position, and is held at the attachment position. In the state where the toner container 3 is attached to the attachment portion 58, the surface of the exterior panel 77 is flush with the right side surface 11A of the housing 11.

In addition, the moving frame 65 is integrally provided with the first cams 660 (an example of a first pressing portion of the present invention). The first cams 660 are provided at positions separated from the second cams 659 in the height direction D11, and specifically, located below the second cams 659. The first cams 660 are inclined cams, and are inclined approximately 45 degrees.

As shown in FIG. 13, the second cams 659 are inclined diagonally upward toward the exterior panel 77, whereas the first cams 660 are inclined diagonally downward toward the exterior panel 77. In the present embodiment, in the depth direction D13, an edge portion 660A of each of the first cams 660 that is on the exterior panel 77 side is disposed closer to the exterior panel 77 than an edge portion 659A of each of the second cams 659 that is on the support frame 61 side.

When the moving frame 65 is moved in a direction where the lock of the projecting bosses 84 is removed by the lock removing portion 120 described below, and the moving frame 65 is moved to the unlock position, the first cams 660 press the toner container 3 from the attachment position to the detachment position. When the moving frame 65 is moved from the lock position to the unlock position, the first cams 660, in response to the movement of the moving frame 65, press the projecting bosses 84 in a direction (the direction indicated by the dotted line arrow in FIG. 14) opposite to the insertion direction of the toner container 3, and move the toner container 3 from the attachment position to the detachment position. The first cams 660 that move the toner container 3 to the detachment position as described here, are an example of a moving mechanism of the present invention.

Specifically, in the state where the toner container 3 has been attached and locked to the attachment portion 58 as shown in FIG. 15, when the moving frame 65 is moved by the lock removing portion 120 (see FIG. 16) toward the unlock position (upward), the first cams 660 abut on the projecting bosses 84 that move from the lock grooves 657 toward the openings 658 relative to the movement of the moving frame 65 (see FIG. 14). At this time, when, in the state where the projecting bosses 84 abut on the first cams 660, the moving frame 65 is further moved toward the unlock position (upward), the first cams 660 convert the upward pressing force received from the moving frame 65 into a pressing force of the direction (the direction indicated by the dotted line arrow in FIG. 14) opposite to the insertion direction of the toner container 3 during the attachment, and apply the force to the projecting bosses 84. When the projecting bosses 84 receive the pressing force, the toner container 3 moves from the attachment position toward the detachment position (see FIG. 14).

As shown in FIG. 14, the first cams 660 cause the projecting bosses 84 to move in the opposite direction to go through the openings 658, be released from the lock grooves 657, and reach a middle position (a position shown in FIG. 14). Here, the middle position is a predetermined position between the attachment position and the detachment position, and is a limit position to which the projecting bosses 84 can be displaced by the first cams 660. In the state where the projecting bosses 84 are disposed at the middle position, the uplift of the moving frame 65 by the lock removing portion 120 described below is removed.

When the uplift of the moving frame 65 is removed at the middle position, the moving frame 65 is moved downward again by the biasing force of the coil spring 68. In this case, the second cams 659 abut on the projecting bosses 84. Subsequently, when, in the state where the projecting bosses 84 abut on the second cams 659, the moving frame 65 is further moved downward, the second cams 659 press the projecting bosses 84 in the opposite direction, and press the toner container 3 that has been pressed to the middle position, from the middle position toward the detachment position.

Specifically, the second cams 659 convert the downward biasing force received from the coil spring 68 into a pressing force of the opposite direction, and apply the pressing force to the projecting bosses 84. When the projecting bosses 84 receive the biasing force, the toner container 3 moves from the middle position toward the unlock position. The second cams 659 that cause the toner container 3 to move from the middle position to the unlock position as described here are an example of the moving mechanism of the present invention. In the state where the toner container 3 has been displaced to the detachment position, the exterior panel 77 projects outward more than the right side surface 11A of the housing 11.

Figure 16:
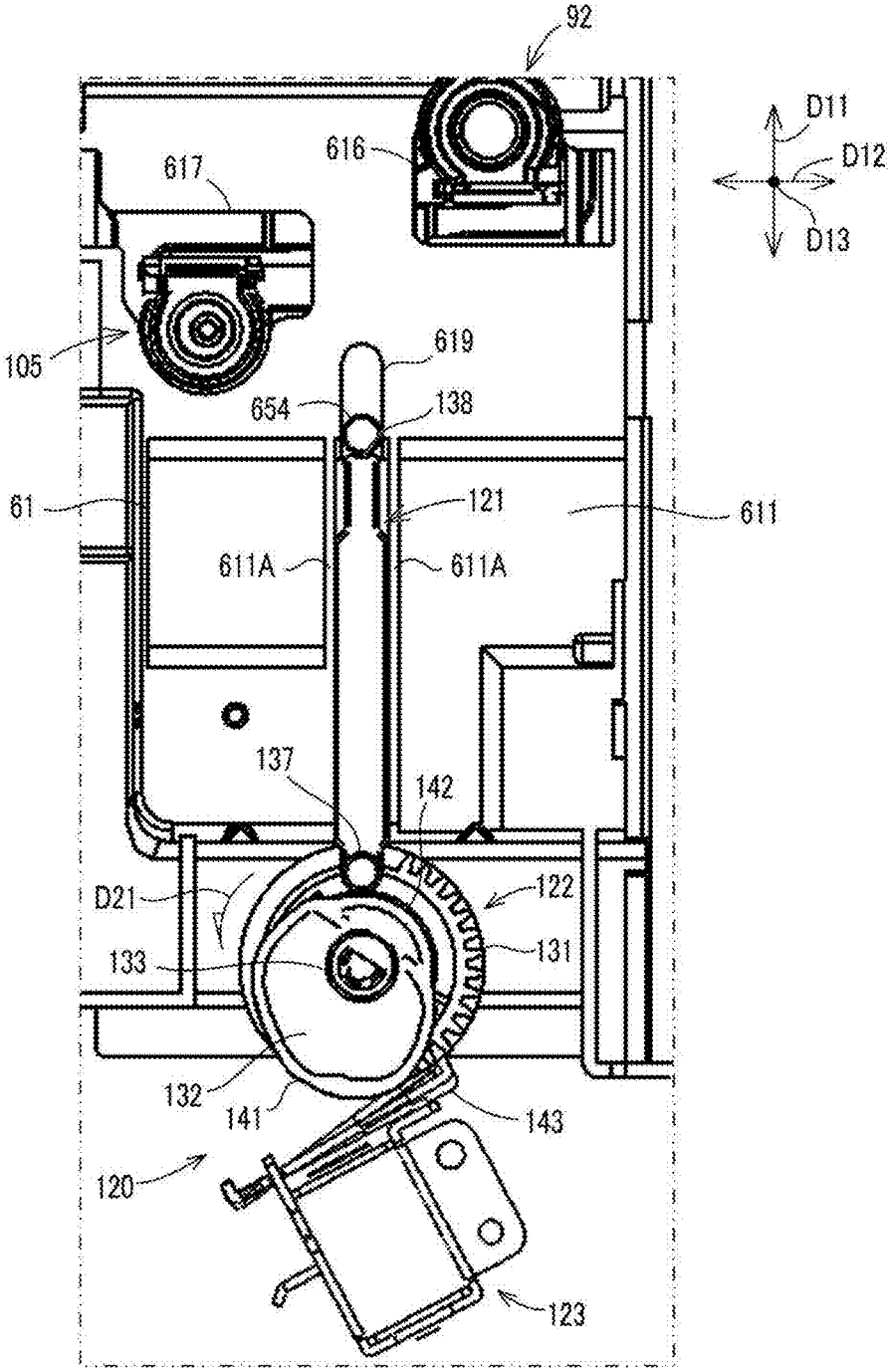
FIG. 16 is a diagram showing a structure of a back surface of the attachment portion to which the toner container is attached.
Figure 17:
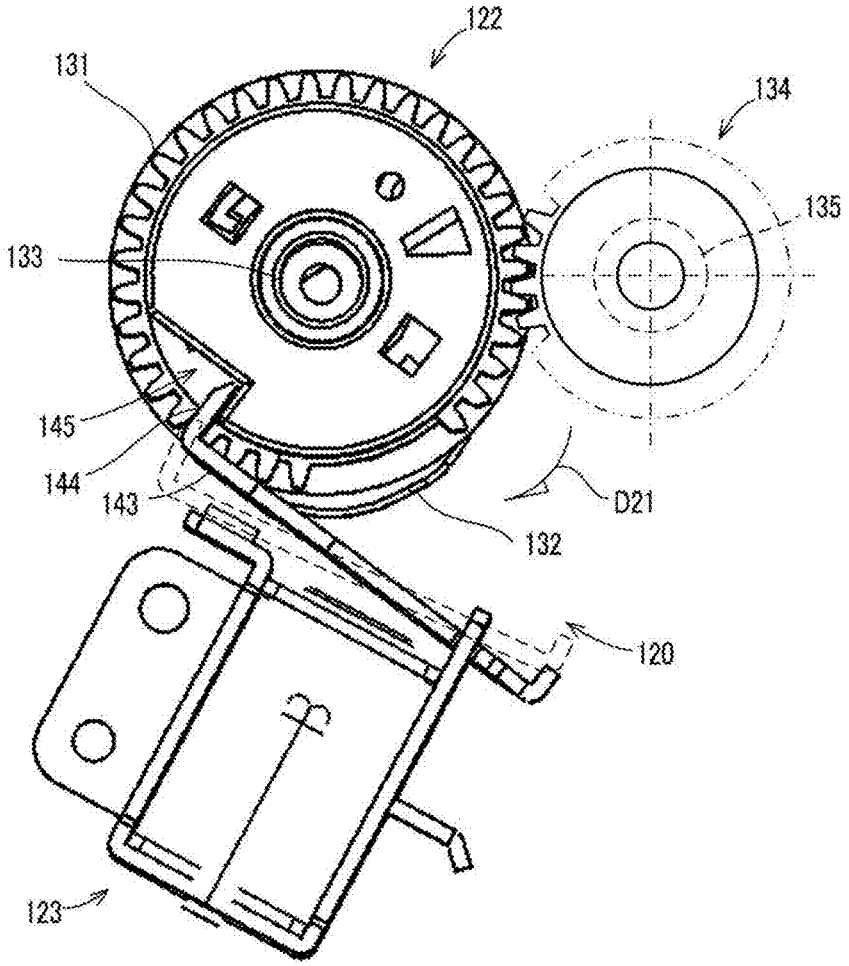
FIG. 17 is an enlarged diagram showing a configuration of a lock removing portion configured to cause the moving frame of the toner container to operate.
Figure 18:
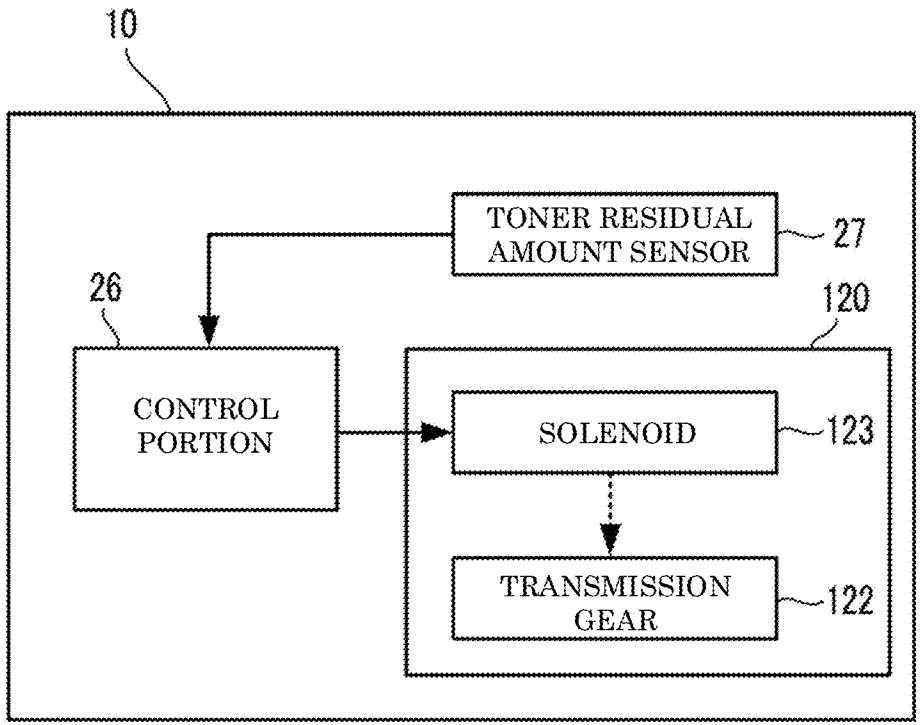
FIG. 18 is a block diagram showing configurations used to control driving of the lock removing portion.

The following describes a configuration of the lock removing portion 120 with reference to FIG. 16 to FIG. 18. It is noted that in the present embodiment, the lock removing portion 120 is provided in each of the four attachment portions 58. Here, FIG. 16 is a diagram showing a structure of a back surface of the attachment portion 58 to which the toner container 3 is attached. FIG. 17 is an enlarged diagram showing a configuration of the lock removing portion 120 for causing the moving frame 65 of the toner container 3 to operate. FIG. 18 is a block diagram showing configurations for controlling driving of the lock removing portion 120.

The lock removing portion 120 is configured to, when a predetermined removal condition is satisfied, move the moving frame 65 from the lock position to the unlock position to remove the lock of the toner container 3. In the present embodiment, when the removal condition is satisfied, the lock removing portion 120 applies an upward pressing force to the boss 654, thereby uplifting and moving the moving frame 65 from the lock position to the unlock position against the biasing force of the coil spring 68.

Specifically, the lock removing portion 120 includes a link member 121, a transmission gear 122 (an example of a transmission member of the present invention), a solenoid 123 (an example of a driving portion of the present invention), and a control portion 26 (an example of a control portion of the present invention; see FIG. 18).

As shown in FIG. 18, the image forming apparatus 10 is provided with a toner residual amount sensor 27 that is configured to detect a residual amount of toner in the toner container 3 attached to the attachment portion 58. The toner residual amount sensor 27 is, for example, a weight sensor for detecting the weight of the toner container 3, or a light sensor for detecting the amount of toner in the upper storage portion 71 of the toner containers 3. The toner residual amount sensor 27 is connected to the control portion 26, and the control portion 26 determines whether the residual amount of toner in the upper storage portion 71 is empty or as little as can be determined as empty based on a detection signal output from the toner residual amount sensor 27. It is noted that instead of using the toner residual amount sensor 27, the control portion 26, for example, may count the number of dots of the toner used by the image forming units 15 based on the image data used in the image forming process, and obtain the toner consumption amount and the toner residual amount based on the cumulative value of the counting.

The transmission gear 122 transmits a rotational driving force supplied thereto to the boss 654 via the link member 121, thereby causing the moving frame 65 to move from the lock position toward the unlock position. As shown in FIG. 16, the transmission gear 122 includes a rotary gear (spur gear) 131, an eccentric cam 132 (an example of a third cam of the present invention), and a rotary shaft 133, wherein the rotary gear 131 is rotationally supported by an inner frame of the housing 11, the eccentric cam 132 is provided on a side surface of the rotary gear 131, and the rotary shaft 133 passes through the center of the rotary gear 131.

FIG. 17 is a diagram of the transmission gear 122 viewed from the rotary gear 131 side. As shown in FIG. 17, the rotary gear 131 meshes with an input gear 134. The input gear 134 is, for example, an idle gear configured to branch a driving force from a motor for driving the driving roller 36, the photoconductor drum 41 and the like of the image forming apparatus 10, and transmit the branched driving force to the rotary gear 131. The input gear 134 is provided with a torque limiter 135. As a result, when a rotation torque applied to the torque limiter 135 is lower than a set torque, the rotational driving force of the input gear 134 is transmitted to the rotary gear 131, and when the rotation torque is equal to or higher than the set torque, the rotational driving force of the input gear 134 is not transmitted to the rotary gear 131.

As shown in FIG. 16, the link member 121 is a stick-like member elongated in the height direction D11, disposed on a back surface of the bottom plate 611. The link member 121 is interposed between the boss 654 and the transmission gear 122, wherein the boss 654 projects from the back surface of the bottom plate 611. Specifically, a pair of guide ribs 611A extending in the height direction D11 are formed on the back surface of the bottom plate 611, and the link member 121 is disposed in a guide groove formed between the guide ribs 611A such that the link member 121 can slide in the height direction D11. A rotatable roller 137 is supported by a lower end portion of the link member 121, and the rotatable roller 137 abuts on an outer peripheral surface of the eccentric cam 132. In addition, an upper end portion 138 of the link member 121 is configured to abut on the boss 654 according to the rotation of the eccentric cam 132.

The eccentric cam 132 rotates according to the rotation of the rotary gear 131, thereby displacing the moving frame 65 between the lock position and the unlock position. The eccentric cam 132 includes an arc-shaped high cam 141 and an arc-shaped low cam 142, wherein the high cam 141 pushes up the link member 121, and the low cam 142 displaces the link member 121 downward. The high cam 141 is formed to be longer than the low cam 142 in the radial direction. When the rotational driving force is transmitted from the input gear 134 to the rotary gear 131, the transmission gear 122 rotates in a direction indicated by the arrow D21 shown in FIG. 16. This allows the high cam 141 and the low cam 142 to alternately abut on the rotatable roller 137, causing the link member 121 to move in the up-down direction. In the present embodiment, when the high cam 141 abuts on the rotatable roller 137, the link member 121 lifts up the boss 654, and moves the moving frame 65 to the unlock position against the biasing force of the coil spring 68. In addition, when the low cam 142 abuts on the rotatable roller 137, the link member 121 is displaced downward. In this case, the moving frame 65 moves to the lock position by the biasing force of the coil spring 68.

As shown in FIG. 17, the solenoid 123 is provided with an actuator 143 (an example of an engaging member of the present invention) that is configured to operate according to the energization state of the solenoid 123. The actuator 143 is displaced between an engagement attitude (a first position) and a retreat attitude (a second position) according to the driving control of the solenoid 123, wherein when the actuator 143 takes the engagement attitude, the actuator 143 is engaged with the transmission gear 122 to stop the rotation operation of the transmission gear 122, and when the actuator 143 takes the retreat attitude, the engagement between the actuator 143 and the transmission gear 122 is removed. An engagement groove 145 is formed in the rotary gear 131 such that an engagement claw 144 provided at a tip of the actuator 143 is inserted in the engagement groove 145.

When the solenoid 123 is in a non-energized state, the actuator 143 is held in the engagement attitude (an attitude indicated by a solid line in FIG. 17) where the engagement claw 144 can be inserted in the engagement groove 145. On the other hand, when the solenoid 123 is energized by the control portion 26, the solenoid 123 causes the actuator 143 to operate to be displaced to the retreat attitude (an attitude indicated by a dotted line in FIG. 17) where the engagement claw 144 is released from the engagement groove 145.

In the present embodiment, upon determining that the residual amount of toner in the upper storage portion 71 is empty, the control portion 26 energizes and drives the solenoid 123 to displace the actuator 143 from the engagement attitude to the retreat attitude. Here, that the residual amount of toner in the upper storage portion 71 is empty is an example of the removal condition of the present invention. When the actuator 143 is in the engagement attitude, a rotation torque equal to or higher than the set torque is applied to the torque limiter 135, thus the rotary gear 131 does not rotate. In addition, in this case, the low cam 142 abuts on the rotatable roller 137 of the link member 121.

On the other hand, when the actuator 143 is displaced to the retreat attitude, a rotation torque lower than the set torque is applied to the torque limiter 135. As a result, a rotational force is transmitted to the rotary gear 131, and the transmission gear 122 rotates in a direction indicated by the arrow D21. With this rotation, the link member 121 is lifted up, and the boss 654 is also lifted up by the link member 121. This allows the moving frame 65 to be moved from the lock position to the unlock position, the lock of the toner container 3 at the attachment position is removed, and the toner container 3 projects outward from the right side surface 11A of the housing 11.

As described above, in the present embodiment, the toner container 3 includes the exterior panel 77. As a result, it is possible to replace the toner container 3 only by ensuring a space sufficient for detachment of the toner container 3 from the attachment portion 58. In addition, with the above-described configuration of the attachment portion 58, it is possible to attach and detach the toner container 3 to/from the attachment portion 58 only by ensuring a space for accommodation of the thickness of the toner container 3 in the depth direction D13. As a result, it is possible to reduce a space required for replacement of the toner container 3 as compared with a conventional one, and improve the freedom of setting the image forming apparatus 10.

In addition, when the control portion 26 determines that the residual amount of toner in the upper storage portion 71 is empty, the lock removing portion 120 acts, the moving frame 65 moves from the lock position to the unlock position, the lock of the toner container 3 at the attachment position is removed, and the toner container 3 projects outward from the right side surface 11A of the housing 11. This makes it possible for the user to easily recognize visually that the toner container 3 that has projected is as an object of replacement.

In addition, when the upper storage portion 71 of a toner container 3 becomes empty, the toner container 3 is automatically pressed out from the attachment position to the detachment position. As a result, when replacing the toner container 3, the user does not need to draw out the toner container 3 to the detachment position, and can easily detach the toner container 3.

In addition, it is not necessary for the exterior panel 77 of the toner container 3 to be provided with an operation member that is used to draw out the toner container 3. This makes it possible to simplify the exterior panel 77 and increase the freedom of design. In addition, since the exterior panel 77 is not provided with an operation member, even in a case where the toner container 3 collides with a person or an object nearby when it is pushed out to the detachment position, there is no damage of the operation member, and it is possible to reduce the injury of the person or the damage of the object collided with the toner container 3.

In addition, since the exterior panel 77 is not provided with an operation member, there is no erroneous operation of the operation member, and the toner container 3 is prevented from being drawn out accidentally.

In the above-described embodiment, the boss 654 is caused to operate via the link member 121. However, the present invention is not limited to the configuration. For example, the eccentric cam 132 may directly come into contact with the boss 654 to cause the boss 654 to operate.

In addition, in the above-described embodiment, the solenoid 123 is used to cause the transmission gear 122 of the lock removing portion 120 to operate. However, the present invention is not limited to the configuration. For example, instead of the solenoid 123, a motor for rotating the transmission gear 122 may be provided, and the control portion 26 may control the rotation of the motor to cause the transmission gear 122 to operate.

In addition, in the above-described embodiment, an example of the removal condition is that the residual amount of toner in the upper storage portion 71 is empty. However, not limited to this, the removal condition may be that a replacement instruction signal has been input from outside to the image forming apparatus 10, or that an abnormality (error) of the toner container 3 has been detected by the control portion 26.

The invention claimed is:

1. An image forming apparatus comprising:

a toner container configured to be attached to an attachment position set in an apparatus main body;

a support member configured to support the toner container so that the toner container can be moved between the attachment position and a detachment position that is separated from the attachment position toward a predetermined first surface of the apparatus main body;

a lock member provided on the support member in such a way as to be movable in a first direction that extends along the first surface, the lock member configured to be displaced between a lock position and a removal position, wherein when the lock member is located at the lock position, the lock member is engaged with the toner container so that the toner container is locked to the attachment position, and when the lock member is located at the removal position, a lock of the toner container is removed;

a lock removing portion configured to, when a predetermined removal condition is satisfied, move the lock member from the lock position to the removal position to remove the lock of the toner container;

an elastic member configured to bias the lock member toward the lock position; and a moving mechanism configured to move the toner container toward the detachment position when the lock removing portion removes the lock, wherein the moving mechanism includes:

a first pressing portion configured to, when the lock removing portion has moved the lock member from the lock position toward the removal position, press the toner container from the attachment position toward the detachment position a second pressing portion configured to press the toner container that has been pressed to a middle position that is set between the attachment position and the detachment position by the first pressing portion, from the middle position toward the detachment position, the lock removing portion moves the lock member toward the removal position against a biasing force of the elastic member, and when the lock member has moved from the lock position to the removal position, the first pressing portion presses the toner container from the attachment position to the middle position.

2. The image forming apparatus according to claim 1, wherein the first pressing portion is a first cam that is provided in the lock member, and converts a pressing force that is received when the lock member is moved by the lock removing portion from the lock position toward the removal position, into a force that biases the toner container toward the detachment position.

3. The image forming apparatus according to claim 1, wherein the second pressing portion is a second cam that is provided in the lock member, and converts the biasing force of the elastic member that is received after the toner container reaches the middle position, into a force that biases the toner container toward the detachment position.

4. The image forming apparatus according to claim 1, wherein the toner container includes an engaging piece that is engaged with the lock member at the attachment position in a second direction perpendicular to the first surface, and the lock member includes a hook portion that is engaged with the engaging piece.

5. The image forming apparatus according to claim 1, wherein the toner container includes an exterior member that constitutes an exterior of the first surface in a state where the toner container is disposed at the attachment position.

6. An image forming apparatus comprising:

a toner container configured to be attached to an attachment position set in an apparatus main body;

a support member configured to support the toner container so that the toner container can be moved between the attachment position and a detachment position that is separated from the attachment position toward a predetermined first surface of the apparatus main body;

a lock member provided on the support member in such a way as to be movable in a first direction that extends along the first surface, the lock member configured to be displaced between a lock position and a removal position, wherein when the lock member is located at the lock position, the lock member is engaged with the toner container so that the toner container is locked to the attachment position, and when the lock member is located at the removal position, a lock of the toner container is removed;

a lock removing portion configured to, when a predetermined removal condition is satisfied, move the lock member from the lock position to the removal position to remove the lock of the toner container; and a moving mechanism configured to move the toner container toward the detachment position when the lock removing portion removes the lock, wherein a long hole extending in the first direction is formed in the support member, the lock member is provided with a projection portion that is inserted in the long hole and is guided in the first direction along the long hole, and the lock removing portion moves the lock member from the lock position to the removal position by applying a force to the projection portion.

7. The image forming apparatus according to claim 6, wherein the lock removing portion includes a transmission member that moves the lock member from the lock position to the removal position by transmitting a driving force to the projection portion.

8. The image forming apparatus according to claim 7, wherein the transmission member includes:

a gear that receives the driving force; and a cam that displaces the lock member between the lock position and the removal position by abutting on the projection portion.

9. The image forming apparatus according to claim 7, wherein the lock removing portion includes:

a driving portion that includes an engaging member that is displaced between a first position and a second position, wherein when the engaging member is located at the first position, the engaging member is engaged with the transmission member to stop an operation of the transmission member, and when the engaging member is located at the second position, an engagement between the engaging member and the transmission member is removed; and a control portion that, when the removal condition is satisfied, controls the driving portion to displace the engaging member from the first position to the second position, thereby moving the lock member from the lock position to the removal position.

10. The image forming apparatus according to claim 9, wherein the removal condition is that an error concerning the toner container has been detected.

* * * * *